US012038187B2

(12) United States Patent
Wellig et al.

(10) Patent No.: US 12,038,187 B2
(45) Date of Patent: Jul. 16, 2024

(54) MULTI-SENSOR PLATFORM FOR A BUILDING

(71) Applicant: Honeywell International Inc., Charlotte, NC (US)

(72) Inventors: Armin Wellig, Mont-sur-Rolle (CH); Jin Haozhe-Jerry, Shanghai (CN); Chenghao Wang, Shanghai (CN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 379 days.

(21) Appl. No.: 17/556,445

(22) Filed: Dec. 20, 2021

(65) Prior Publication Data

US 2023/0101344 A1 Mar. 30, 2023

Related U.S. Application Data

(63) Continuation of application No. PCT/CN2021/121137, filed on Sep. 28, 2021.

(51) Int. Cl.
*F24F 11/38* (2018.01)
*F24F 11/39* (2018.01)
(Continued)

(52) U.S. Cl.
CPC ..... *F24F 11/38* (2018.01); *F24F 11/39* (2018.01); *F24F 11/56* (2018.01); *F24F 11/89* (2018.01)

(58) Field of Classification Search
CPC .. F24F 11/38; F24F 11/39; F24F 11/89; F24F 11/56
(Continued)

(56) References Cited

U.S. PATENT DOCUMENTS 191,512 A 6/1877 Bennett et al.
4,009,647 A 3/1977 Howorth
(Continued)

FOREIGN PATENT DOCUMENTS

CA 2387100 A1 11/2003
CA 2538139 A1 3/2005
(Continued)

OTHER PUBLICATIONS

"Energy Manager User Guide," Release 3.2, Honeywell, 180 pages, 2008.

(Continued)

*Primary Examiner* — Ronald D Hartman, Jr.
(74) *Attorney, Agent, or Firm* — Seager, Tufte & Wickhem, LLP

(57) ABSTRACT

A sensing assembly includes a baseboard and a daughterboard operatively coupled to the baseboard. The baseboard includes a microcontroller unit (MCU) mounted to the baseboard, the MCU executing a Real Time Operating System (RTOS) and embedded Artificial Intelligence (AI) code, and two or more sensors that are mounted to the baseboard and operatively coupled to the MCU. The daughterboard includes two or more sensors that are mounted to the daughterboard. The MCU is configured to receive an output signal from each of the two or more sensors mounted to the daughterboard and the two or more sensors mounted to the baseboard and to process two or more of the output signals using the embedded AI code to produce one or more output parameters. The baseboard includes communication circuitry for communicating one or more of the output parameters to a remote device such as a remote server.

20 Claims, 10 Drawing Sheets

(51) Int. Cl.
*F24F 11/56* (2018.01)
*F24F 11/89* (2018.01)

(58) Field of Classification Search
USPC ..... 700/276
See application file for complete search history.

(56) References Cited

U.S. PATENT DOCUMENTS 4,375,637 A 3/1983 Desjardins
4,918,615 A 4/1990 Suzuki et al.
4,939,922 A 7/1990 Smalley et al.
5,566,084 A 10/1996 Cmar
5,727,579 A 3/1998 Chardack
5,745,126 A 4/1998 Jain et al.
5,751,916 A 5/1998 Kon et al.
5,777,598 A 7/1998 Gowda et al.
5,973,662 A 10/1999 Singers et al.
6,065,842 A 5/2000 Fink
6,139,177 A 10/2000 Venkatraman et al.
6,144,993 A 11/2000 Fukunaga et al.
6,157,943 A 12/2000 Meyer
6,229,429 B1 5/2001 Horon
6,238,337 B1 5/2001 Kambhatla et al.
6,250,601 B1 6/2001 Kolar et al.
6,334,211 B1 12/2001 Kojima et al.
6,353,853 B1 3/2002 Gravlin
6,369,695 B2 4/2002 Horon
6,375,038 B1 4/2002 Daansen et al.
6,429,868 B1 8/2002 Dehner, Jr. et al.
6,473,084 B1 10/2002 Phillips et al.
6,487,457 B1 11/2002 Hull et al.
6,580,950 B1 6/2003 Johnson et al.
6,598,056 B1 7/2003 Hull et al.
6,619,555 B2 9/2003 Rosen
6,704,012 B1 3/2004 Lefave
6,712,269 B1 3/2004 Watkins
6,720,874 B2 4/2004 Fufido et al.
6,741,915 B2 5/2004 Poth
6,796,896 B2 9/2004 Laiti
6,801,199 B1 10/2004 Wallman
6,816,878 B1 11/2004 Zimmers et al.
6,876,951 B2 4/2005 Skidmore et al.
6,882,278 B2 4/2005 Winings et al.
6,904,385 B1 6/2005 Budike, Jr.
6,907,387 B1 6/2005 Reardon
6,911,177 B2 6/2005 Deal
6,993,403 B1 1/2006 Dadebo et al.
6,993,417 B2 1/2006 Osann, Jr.
7,023,440 B1 4/2006 Havekost et al.
7,031,880 B1 4/2006 Seem et al.
7,062,722 B1 6/2006 Carlin et al.
7,110,843 B2 9/2006 Pagnano et al.
7,139,685 B2 11/2006 Bascle et al.
7,164,972 B2 1/2007 Imhof et al.
7,183,899 B2 2/2007 Behnke
7,200,639 B1 4/2007 Yoshida
7,222,111 B1 5/2007 Budike, Jr.
7,222,800 B2 5/2007 Wruck
7,257,397 B2 8/2007 Shamoon et al.
7,280,030 B1 10/2007 Monaco
7,292,908 B2 11/2007 Borne et al.
7,295,116 B2 11/2007 Kumar et al.
7,302,313 B2 11/2007 Sharp et al.
7,308,323 B2 12/2007 Kruk et al.
7,308,388 B2 12/2007 Beverina et al.
7,313,447 B2 12/2007 Hsiung et al.
7,346,433 B2 3/2008 Budike, Jr.
7,356,548 B1 4/2008 Culp et al.
7,379,782 B1 5/2008 Cocco
7,383,148 B2 6/2008 Ahmed
7,434,742 B2 10/2008 Mueller et al.
7,447,333 B1 11/2008 Masticola et al.
7,466,224 B2 12/2008 Ward et al.
7,496,472 B2 2/2009 Seem
7,512,450 B2 3/2009 Ahmed
7,516,490 B2 4/2009 Riordan et al.
7,548,833 B2 6/2009 Ahmed
7,551,092 B1 6/2009 Henry
7,552,030 B2 6/2009 Guralnik et al.
7,557,729 B2 7/2009 Hubbard et al.
7,567,844 B2 7/2009 Thomas et al.
7,596,473 B2 9/2009 Hansen et al.
7,610,910 B2 11/2009 Ahmed
7,626,507 B2 12/2009 LaCasse
7,664,574 B2 2/2010 Imhof et al.
7,682,464 B2 3/2010 Glenn et al.
7,688,212 B2 3/2010 Farley
7,702,421 B2 4/2010 Sullivan et al.
7,729,882 B2 6/2010 Seem
7,755,494 B2 7/2010 Melker et al.
7,761,310 B2 7/2010 Rodgers
7,774,227 B2 8/2010 Srivastava
7,797,188 B2 9/2010 Srivastava
7,819,136 B1 10/2010 Eddy
7,822,806 B2 10/2010 Frank et al.
7,856,370 B2 12/2010 Katta et al.
7,944,358 B2 5/2011 Sorensen et al.
7,978,083 B2 7/2011 Melker et al.
7,984,384 B2 7/2011 Chaudhri et al.
7,986,323 B2 7/2011 Kobayashi et al.
8,014,970 B2 9/2011 Gulati et al.
8,024,666 B2 9/2011 Thompson
8,051,156 B1 11/2011 Sharma et al.
8,086,047 B2 12/2011 Penke et al.
8,099,178 B2 1/2012 Mairs et al.
8,151,280 B2 4/2012 Sather et al.
8,176,095 B2 5/2012 Murray et al.
8,218,871 B2 7/2012 Angell et al.
8,219,660 B2 7/2012 McCoy et al.
8,271,941 B2 9/2012 Zhang et al.
8,294,585 B2 10/2012 Barnhill
8,302,020 B2 10/2012 Louch et al.
8,320,634 B2 11/2012 Deutsch
8,334,422 B2 12/2012 Gutsol et al.
8,344,893 B1 1/2013 Drammeh
8,375,118 B2 2/2013 Hao et al.
8,395,515 B2 3/2013 Tokhtuev et al.
8,476,590 B2 7/2013 Stratmann et al.
8,516,016 B2 8/2013 Park et al.
8,558,660 B2 10/2013 Nix et al.
8,639,527 B2 1/2014 Rensvold et al.
8,698,637 B2 4/2014 Raichman
8,718,981 B2 5/2014 Bey et al.
8,816,860 B2 8/2014 Ophardt et al.
8,869,027 B2 10/2014 Louch et al.
8,904,497 B2 12/2014 Hsieh
8,936,944 B2 1/2015 Peltz et al.
8,947,437 B2 2/2015 Garr et al.
8,950,019 B2 2/2015 Loberger et al.
9,000,926 B2 4/2015 Hollock et al.
9,030,325 B2 5/2015 Taneff
9,098,738 B2 8/2015 Bilet et al.
9,098,993 B2 8/2015 Reed, Jr.
9,105,071 B2 8/2015 Fletcher et al.
9,175,356 B2 11/2015 Peltz et al.
9,240,111 B2 1/2016 Scott et al.
9,280,884 B1 3/2016 Schultz et al.
9,292,972 B2 3/2016 Hailemariam et al.
9,320,662 B2 4/2016 Hayes et al.
9,370,600 B1 6/2016 DuPuis et al.
9,373,242 B1 6/2016 Conrad et al.
9,396,638 B2 7/2016 Wildman et al.
9,311,807 B2 8/2016 Schultz et al.
9,406,212 B2 8/2016 De Luca et al.
9,418,535 B1 8/2016 Felch et al.
9,418,536 B1 8/2016 Felch et al.
9,449,219 B2 9/2016 Bilet et al.
9,477,543 B2 10/2016 Henley et al.
9,497,832 B2 11/2016 Verberkt et al.
9,513,364 B2 12/2016 Hall et al.
9,526,380 B2 12/2016 Hamilton et al.
9,526,806 B2 12/2016 Park et al.
9,536,415 B2 1/2017 De Luca et al.
9,538,578 B1 1/2017 Stamakakis et al.

(56) References Cited

U.S. PATENT DOCUMENTS 9,558,648 B2 1/2017 Douglas
9,591,267 B2 3/2017 Lipton et al.
9,613,518 B2 4/2017 Dunn et al.
9,618,224 B2 4/2017 Emmons et al.
9,618,918 B2 4/2017 O'Keefe
9,640,059 B2 5/2017 Hyland
9,672,360 B2 6/2017 Barkan
9,685,065 B2 6/2017 Diels
9,710,700 B2 7/2017 Bilet et al.
9,715,242 B2 7/2017 Pillai et al.
9,721,452 B2 8/2017 Felch et al.
9,729,341 B2 8/2017 Kaps et al.
9,729,945 B2 8/2017 Schultz et al.
9,784,464 B2 10/2017 Yamamoto et al.
9,843,743 B2 12/2017 Lewis et al.
9,856,634 B2 1/2018 Rodenbeck et al.
9,872,088 B2 1/2018 Fadell et al.
9,875,639 B2 1/2018 Bone et al.
9,911,312 B2 3/2018 Wildman et al.
9,940,819 B2 4/2018 Ferniany
9,956,306 B2 5/2018 Brais et al.
9,986,175 B2 5/2018 Frank et al.
10,087,608 B2 10/2018 Dobizl et al.
10,171,891 B1 1/2019 Stamatakis
10,223,894 B2 3/2019 Raichman
10,228,837 B2 3/2019 Hua et al.
10,235,865 B2 3/2019 Thyroff
10,251,610 B2 4/2019 Parthasarathy et al.
10,298,411 B2 5/2019 Donlan et al.
10,303,843 B2 5/2019 Bitran et al.
10,332,382 B2 6/2019 Thyroff
10,382,893 B1 8/2019 Wootton et al.
10,469,590 B2 11/2019 Scanlin et al.
10,513,416 B2 12/2019 Fang et al.
10,514,817 B2 12/2019 Hua et al.
10,565,844 B2 2/2020 Pourmohammad et al.
10,602,474 B2 3/2020 Goldstein
10,607,147 B2 3/2020 Raykov et al.
10,609,304 B2 3/2020 Soper et al.
10,613,504 B2 4/2020 Chowdhury
10,659,289 B2 5/2020 Shif et al.
10,691,081 B2 6/2020 Ray
10,705,108 B1 7/2020 Moens et al.
10,708,154 B2 7/2020 Pefkianakis et al.
10,721,088 B2 7/2020 Saxena et al.
10,866,003 B2 12/2020 Ajax
10,944,830 B2 3/2021 Scanlin
2002/0111698 A1 8/2002 Graziano et al.
2002/0130868 A1 9/2002 Smith
2003/0028269 A1 2/2003 Spriggs et al.
2003/0030637 A1 2/2003 Grinstein et al.
2003/0046862 A1 3/2003 Wolf et al.
2003/0071814 A1 4/2003 Jou et al.
2003/0078677 A1 4/2003 Hull et al.
2003/0083957 A1 5/2003 Olefson
2003/0103075 A1 6/2003 Rosselot
2003/0171851 A1 9/2003 Brickfield et al.
2003/0214400 A1 11/2003 Mizutani et al.
2003/0233432 A1 12/2003 Davis et al.
2004/0001009 A1 1/2004 Winings et al.
2004/0030531 A1 2/2004 Miller et al.
2004/0064260 A1 4/2004 Padmanabhan et al.
2004/0143474 A1 7/2004 Haeberle et al.
2004/0153437 A1 8/2004 Buchan
2004/0168115 A1 8/2004 Bauernschmidt et al.
2004/0233192 A1 11/2004 Hopper
2004/0260411 A1 12/2004 Cannon
2005/0010460 A1 1/2005 Mizoguchi et al.
2005/0119767 A1 6/2005 Kiwimagi et al.
2005/0143863 A1 6/2005 Ruane et al.
2005/0267900 A1 12/2005 Ahmed et al.
2006/0004841 A1 1/2006 Heikkonen et al.
2006/0009862 A1 1/2006 Imhof et al.
2006/0017547 A1 1/2006 Buckingham et al.
2006/0020177 A1 1/2006 Seo et al.
2006/0028471 A1 2/2006 Kincaid et al.
2006/0029256 A1 2/2006 Miyoshi et al.
2006/0058900 A1 3/2006 Johanson et al.
2006/0067545 A1 3/2006 Lewis et al.
2006/0067546 A1 3/2006 Lewis et al.
2006/0077255 A1 4/2006 Cheng
2006/0184326 A1 8/2006 McNally et al.
2006/0231568 A1 10/2006 Lynn et al.
2006/0265664 A1 11/2006 Simons et al.
2006/0279630 A1 12/2006 Aggarwal et al.
2007/0016955 A1 1/2007 Goldberg et al.
2007/0055757 A1 3/2007 Mairs et al.
2007/0055760 A1 3/2007 McCoy et al.
2007/0061046 A1 3/2007 Mairs et al.
2007/0067062 A1 3/2007 Mairs et al.
2007/0088534 A1 4/2007 MacArthur et al.
2007/0090951 A1 4/2007 Chan et al.
2007/0091091 A1 4/2007 Gardiner et al.
2007/0101433 A1 5/2007 Louch et al.
2007/0114295 A1 5/2007 Jenkins
2007/0120652 A1 5/2007 Behnke
2007/0139208 A1 6/2007 Kates
2007/0216682 A1 9/2007 Navratil et al.
2007/0219645 A1 9/2007 Thomas et al.
2007/0239484 A1 10/2007 Arond et al.
2007/0268122 A1 11/2007 Kow et al.
2008/0001763 A1 1/2008 Raja et al.
2008/0027587 A1 1/2008 Nickerson et al.
2008/0027885 A1 1/2008 Van Putten et al.
2008/0036593 A1 2/2008 Rose-Pehrsson et al.
2008/0062167 A1 3/2008 Boggs et al.
2008/0067244 A1 3/2008 Marks
2008/0099045 A1 5/2008 Glenn et al.
2008/0103798 A1 5/2008 Domenikos et al.
2008/0120396 A1 5/2008 Jayaram et al.
2008/0144885 A1 6/2008 Zucherman et al.
2008/0183424 A1 7/2008 Seem
2008/0194009 A1 8/2008 Marentis
2008/0198231 A1 8/2008 Ozdemir et al.
2008/0209342 A1 8/2008 Taylor et al.
2008/0222565 A1 9/2008 Taylor et al.
2008/0224862 A1 9/2008 Cirker
2008/0242945 A1 10/2008 Gugliotti et al.
2008/0250800 A1 10/2008 Wetzel
2008/0279420 A1 11/2008 Masticola et al.
2008/0280275 A1 11/2008 Collopy
2008/0303658 A1 12/2008 Melker et al.
2008/0306985 A1 12/2008 Murray et al.
2008/0320552 A1 12/2008 Kumar et al.
2009/0001181 A1 1/2009 Siddaramanna et al.
2009/0024944 A1 1/2009 Louch et al.
2009/0065596 A1 3/2009 Seem et al.
2009/0083120 A1 3/2009 Strichman et al.
2009/0096791 A1 4/2009 Abshear et al.
2009/0125337 A1 5/2009 Abri
2009/0125825 A1 5/2009 Rye et al.
2009/0144023 A1 6/2009 Seem
2009/0157744 A1 6/2009 McConnell
2009/0160673 A1 6/2009 Cirker
2009/0237651 A1 9/2009 Arndt et al.
2009/0322782 A1 12/2009 Kimchi et al.
2010/0048167 A1 2/2010 Chow et al.
2010/0058248 A1 3/2010 Park
2010/0064001 A1 3/2010 Daily
2010/0070089 A1 3/2010 Harrod et al.
2010/0073162 A1 3/2010 Johnson et al.
2010/0103019 A1 4/2010 Ammar
2010/0123560 A1 5/2010 Nix et al.
2010/0134296 A1 6/2010 Hwang
2010/0156628 A1 6/2010 Ainsbury et al.
2010/0156630 A1 6/2010 Ainsbury
2010/0188228 A1 7/2010 Hyland
2010/0223198 A1 9/2010 Noureldin et al.
2010/0249955 A1 9/2010 Sitton
2010/0286937 A1* 11/2010 Hedley ..... G06Q 50/06 702/60
2010/0318200 A1 12/2010 Foslien et al.
2010/0324962 A1 12/2010 Nesler et al.
2011/0010654 A1 1/2011 Raymond et al.

(56) References Cited

U.S. PATENT DOCUMENTS

2011/0057799 A1 3/2011 Taneff
2011/0077779 A1 3/2011 Fuller et al.
2011/0083094 A1 4/2011 Aycock et al.
2011/0087988 A1 4/2011 Ray et al.
2011/0112854 A1 5/2011 Koch et al.
2011/0126111 A1 5/2011 Gill et al.
2011/0154426 A1 6/2011 Doser et al.
2011/0161124 A1 6/2011 Lappinga et al.
2011/0169646 A1 7/2011 Raichman
2011/0184563 A1 7/2011 Foslien et al.
2011/0202467 A1 8/2011 Hilber et al.
2011/0273298 A1 11/2011 Snodgrass et al.
2011/0291841 A1 12/2011 Hollock et al.
2011/0295583 A1 12/2011 Hollock et al.
2011/0298301 A1 12/2011 Wong et al.
2011/0316703 A1 12/2011 Butler et al.
2011/0320054 A1 12/2011 Brzezowski
2012/0022700 A1 1/2012 Drees et al.
2012/0039503 A1 2/2012 Chen et al.
2012/0062382 A1 3/2012 Taneff
2012/0066168 A1 3/2012 Fadell
2012/0075464 A1 3/2012 Derenne et al.
2012/0109988 A1 5/2012 Li et al.
2012/0112883 A1 5/2012 Wallace et al.
2012/0112906 A1 5/2012 Borke et al.
2012/0131217 A1 5/2012 Delorme et al.
2012/0158185 A1 6/2012 El-Mankabady et al.
2012/0216243 A1 8/2012 Gill et al.
2012/0224057 A1 9/2012 Gill et al.
2012/0259466 A1 10/2012 Ray et al.
2012/0262472 A1 10/2012 Garr et al.
2012/0272146 A1 10/2012 D'souza et al.
2012/0276517 A1 11/2012 Banaszuk et al.
2012/0291068 A1 11/2012 Khushoo et al.
2012/0303652 A1 11/2012 Tseng
2012/0310418 A1 12/2012 Harrod et al.
2013/0007316 A1 1/2013 Moon et al.
2013/0055132 A1 2/2013 Foslien
2013/0060794 A1 3/2013 Puttabasappa et al.
2013/0082842 A1 4/2013 Balazs et al.
2013/0086152 A1 4/2013 Hersche et al.
2013/0091631 A1 4/2013 Hayes et al.
2013/0110295 A1 5/2013 Zheng et al.
2013/0169681 A1 7/2013 Rasane et al.
2013/0184880 A1 7/2013 McMahon
2013/0187775 A1 7/2013 Marsden et al.
2013/0204570 A1 8/2013 Mendelson et al.
2013/0229276 A1 9/2013 Hunter
2013/0268293 A1 10/2013 Knudson et al.
2013/0289774 A1 10/2013 Day et al.
2014/0032157 A1 1/2014 Khiani
2014/0040998 A1* 2/2014 Hsieh ..... G06F 21/45 726/5
2014/0046490 A1 2/2014 Foslien et al.
2014/0046722 A1 2/2014 Rosenbloom et al.
2014/0058539 A1 2/2014 Park
2014/0079282 A1 3/2014 Marcheselli
2014/0167917 A2 6/2014 Wallace et al.
2014/0207291 A1* 7/2014 Golden ..... F24F 11/30 700/277
2014/0266693 A1 9/2014 Moulton
2014/0292518 A1 10/2014 Wildman et al.
2014/0307076 A1 10/2014 Deutsch
2014/0309757 A1 10/2014 Le Sant et al.
2014/0316582 A1 10/2014 Berg-Sonne et al.
2014/0320289 A1 10/2014 Raichman
2014/0342724 A1 11/2014 Hill et al.
2015/0022316 A1 1/2015 Dixon et al.
2015/0025329 A1 1/2015 Amarasingham et al.
2015/0032264 A1 1/2015 Emmons et al.
2015/0056909 A1 2/2015 Chien
2015/0070174 A1 3/2015 Douglas
2015/0077258 A1 3/2015 Nelson et al.
2015/0113462 A1 4/2015 Chen et al.
2015/0153918 A1* 6/2015 Chen ..... G06Q 10/0639 715/771
2015/0156567 A1 6/2015 Oliver et al.
2015/0161874 A1 6/2015 Thyroff et al.
2015/0167995 A1 6/2015 Fadell et al.
2015/0168949 A1 6/2015 Hua et al.
2015/0194043 A1 7/2015 Dunn et al.
2015/0198707 A1 7/2015 Al-Alusi
2015/0212717 A1* 7/2015 Nair ..... G06F 9/451 715/769
2015/0213222 A1 7/2015 Amarasingham et al.
2015/0213379 A1 7/2015 Nair et al.
2015/0216369 A1 8/2015 Hamilton et al.
2015/0253748 A1 9/2015 Brun et al.
2015/0281287 A1 10/2015 Gill et al.
2015/0310312 A1 10/2015 Mongeon
2015/0369505 A1* 12/2015 Malve ..... F24F 11/64 700/276
2016/0027278 A1 1/2016 McIntosh et al.
2016/0061476 A1 3/2016 Schultz et al.
2016/0061477 A1 3/2016 Schultz et al.
2016/0061794 A1 3/2016 Schultz et al.
2016/0061795 A1 3/2016 Schultz et al.
2016/0063833 A1 3/2016 Schultz et al.
2016/0066067 A1 3/2016 Schultz et al.
2016/0110833 A1 4/2016 Fix
2016/0116181 A1 4/2016 Aultman et al.
2016/0139067 A1 5/2016 Grace
2016/0178225 A1* 6/2016 Vallikannu ..... F24F 11/30 700/275
2016/0253897 A1 9/2016 Wildman et al.
2016/0255516 A1 9/2016 Hill et al.
2016/0298864 A1 10/2016 Ekolind et al.
2016/0306934 A1 10/2016 Sperry et al.
2016/0314683 A1 10/2016 Felch et al.
2016/0328948 A1 11/2016 Ferniany
2016/0335731 A1 11/2016 Hall
2016/0367925 A1 12/2016 Blackley
2016/0371619 A1 12/2016 Foster
2017/0024986 A1 1/2017 Austin
2017/0193792 A1 7/2017 Bermudez Rodriguez et al.
2017/0256155 A1 9/2017 Sengstaken, Jr.
2017/0280949 A1 10/2017 Wildman et al.
2017/0294106 A1 10/2017 Thyroff
2017/0301220 A1* 10/2017 Jarrell ..... H04W 4/70
2017/0323376 A1 11/2017 Glaser et al.
2017/0363721 A1 12/2017 Yang et al.
2017/0365024 A1 12/2017 Koch et al.
2018/0004178 A1 1/2018 Haines
2018/0005382 A1 1/2018 Wang et al.
2018/0016773 A1 1/2018 Chandler et al.
2018/0053397 A1 2/2018 Kaur
2018/0106897 A1 4/2018 Shouldice et al.
2018/0113897 A1 4/2018 Donlan
2018/0120412 A1 5/2018 Kim
2018/0151054 A1 5/2018 Pi
2018/0218591 A1 8/2018 Easter
2018/0292098 A1 10/2018 Bandyopadhyay et al.
2018/0293038 A1 10/2018 Meruva et al.
2018/0301014 A1 10/2018 Worral et al.
2018/0313695 A1 11/2018 Shim et al.
2018/0365957 A1 12/2018 Wright et al.
2019/0012607 A1 1/2019 Holliday
2019/0035250 A1 1/2019 Hunter et al.
2019/0049139 A1 2/2019 Ko
2019/0051138 A1 2/2019 Easter
2019/0139395 A1 5/2019 Rogachev et al.
2019/0209719 A1 7/2019 Andersen et al.
2019/0227156 A1 7/2019 Santra et al.
2019/0295386 A1 9/2019 Roberts
2019/0323897 A1 10/2019 Wang et al.
2020/0009280 A1 1/2020 Kupa et al.
2020/0074836 A1 3/2020 Kolavennu et al.
2020/0090089 A1 3/2020 Aston et al.
2020/0146557 A1 5/2020 Cheung et al.
2020/0162503 A1 5/2020 Shurtleff et al.
2020/0177485 A1 6/2020 Shurtleff et al.
2020/0200420 A1 6/2020 Nayak et al.
2020/0226363 A1 7/2020 Holliday et al.

(56) References Cited

U.S. PATENT DOCUMENTS

| | | | |
|---|---|---|---|
| 2020/0327315 | A1 | 10/2020 | Mullins |
| 2020/0364999 | A1 | 11/2020 | Mullins |
| 2021/0027882 | A1 | 1/2021 | Wellig |
| 2021/0150380 | A1 | 5/2021 | Verteletskyi et al. |
| 2021/0208555 | A1 | 7/2021 | Palanivel et al. |
| 2021/0396861 | A1 | 12/2021 | Wellig |
| 2022/0021667 | A1 | 1/2022 | Wellig et al. |

FOREIGN PATENT DOCUMENTS

| | | | |
|---|---|---|---|
| CN | 103110410 | A | 5/2013 |
| CN | 103970977 | A | 8/2014 |
| CN | 105116848 | A | 12/2015 |
| CN | 108961714 | A | 12/2018 |
| CN | 110009245 | A | 7/2019 |
| CN | 110084928 | A | 8/2019 |
| CN | 110456343 | A | 11/2019 |
| CN | 209785093 | U | 12/2019 |
| CN | 110827457 | A | 2/2020 |
| EP | 1669912 | A1 | 6/2006 |
| EP | 2310981 | A1 | 4/2011 |
| EP | 3723456 | A1 | 10/2020 |
| IN | 369935 | A1 | 10/2015 |
| JP | 7085166 | A | 3/1995 |
| JP | 11024735 | A | 1/1999 |
| JP | 11317936 | A | 11/1999 |
| JP | 2001356813 | A | 12/2001 |
| JP | 2005242531 | A | 9/2005 |
| JP | 2005311563 | A | 11/2005 |
| KR | 10195017 | B1 | 12/2011 |
| KR | 1172747 | B1 | 8/2012 |
| KR | 101445367 | B1 | 10/2014 |
| KR | 1499081 | B1 | 3/2015 |
| WO | 9621264 | A3 | 11/1996 |
| WO | 2004029518 | A1 | 4/2004 |
| WO | 2005045715 | A2 | 5/2005 |
| WO | 2008152433 | A1 | 12/2008 |
| WO | 2008157755 | A1 | 12/2008 |
| WO | 2009012319 | A2 | 1/2009 |
| WO | 2009079648 | A1 | 6/2009 |
| WO | 2010106474 | A1 | 9/2010 |
| WO | 2011025085 | A1 | 3/2011 |
| WO | 2011043732 | A1 | 4/2011 |
| WO | 2011057173 | A2 | 5/2011 |
| WO | 2011123743 | A1 | 10/2011 |
| WO | 2013062725 | A1 | 5/2013 |
| WO | 2013178819 | A1 | 12/2013 |
| WO | 2014009291 | A1 | 1/2014 |
| WO | 2014098861 | A1 | 6/2014 |
| WO | 2014135517 | A1 | 9/2014 |
| WO | 2016123536 | A1 | 8/2016 |
| WO | 2017057274 | A1 | 4/2017 |
| WO | 2018206934 | A1 | 11/2018 |
| WO | 2019046580 | A1 | 3/2019 |
| WO | 2020024553 | A1 | 2/2020 |

OTHER PUBLICATIONS

"Fuzzy Logic Toolbox 2.1, Design and Stimulate Fuzzy Logic Systems," The MathWorks, 2 pages, May 2004.
"Junk Charts, Recycling Chartjunk as junk art," 3 pages, Oct. 2, 2006.
"Model Predictive Control Toolbox 2, Develop Internal Model-Based Controllers for Constrained Multivariable Processes," The MathWorks, 4 pages, Mar. 2005.
Honeywell, "Product Guide 2004," XP-002472407, 127 pages, 2004.
"Statistics Toolbox, for Use with Matlab," User's Guide Version2, The MathWorks, 408 pages, Jan. 1999.
"Vykon Energy Suite Student Guide," Tridium Inc., 307 pages, Mar. 3, 2006.
"Web Based Energy Information Systems for Energy Management and Demand Response in Commercial Buildings," California Energy Commission, 80 pages, Oct. 2003.
Andover Controls, Network News, vol. 2, No. 2, 8 pages, 1997.
Andover Controls World, 4 pages, Spring 1997.
Bell, Michael B. et al., "Early Event Detection-Results from A Prototype Implementation," AICHE Spring National Meeting, 15 pages, Apr. 2005.
CADGRAPHICS, "The CADGRAPHICS User's Guide," 198 pages, 2003.
Carrier Comfort Network CCN Web, "Web Browser User Interface to the Carrier Comfort Network," 2 pages, 2002.
Carrier Comfort Network CCN Web, Overview and Configuration Manual, 134 pages, Apr. 2006.
Carrier Comfort Network CCN Web, Product Data, 2 pages, Apr. 2006.
Carrier, "i-Vu Powerful and Intuitive Front End for Building Control," 2 pages, Aug. 2005.
Carrier, "i-Vu Web-Based Integrated Control System," 3 pages, 2005.
Carrier, Demo Screen Shots, 15 pages, prior to Aug. 27, 2007.
Carrier, i-Vu CCN 4.0, Owner's Guide, 20 pages, Jul. 2007.
Carrier, i-Vu CCN, 7 pages, 2007.
Chen, Tony. F., "Rank Revealing QR Factorizations," Linear Algebra and It's Applications, vol. 88-89, p. 67-82, Apr. 1987.
Circon, "i-Browse Web-Based Monitoring and Control for Facility Management," 2 pages, prior to Aug. 27, 2007.
Published Australian Application 2009904740, 28 pages, Application Filed on Sep. 29, 2009.
Echelon, "Energy Control Solutions with the i.Lon SmartServer," 4 pages, 2007.
Echelon, "i.Lon 100e3 Internet Server Models 72101R-300, 72101R-308, 72102R-300, 72103-R300 . . . " 5 pages, copyright 2002-2007.
Echelon, "i.Lon 100e3 Internet Server New Features," 15 pages, Sep. 2006.
Echelon, "i.Lon SmartServer," 5 pages, 2007.
Honeywell News Release, "Honeywell's New Sysnet Facilities Integration System for Boiler Plant and Combustion Safety Processes," 4 pages, Dec. 15, 1995.
Honeywell, "Excel Building Supervisor-Integrated R7044 and FS90 Ver. 2.0," Operator Manual, 70 pages, Apr. 1995.
Honeywell, "Introduction of the S7350A Honeywell WebPAD Information Appliance," Home and Building Control Bulletin, 2 pages, Aug. 29, 2000; Picture of WebPad Device with touch screen, 1 Page; and screen shots of WebPad Device, 4 pages.
Honeywell, Excel 15B W7760B Building Manager Release 2.02.00, Installation Instructions, 28 pages, Dec. 2004.
Honeywell, The RapidZone Solution, Excel 5000 Open System, Application Guide, 52 pages, Jan. 2004.
http://pueblo.lbl.gov/~olken . . . , "Remote Building Monitoring and Operations Home Page," 5 pages, prior to Aug. 27, 2007.
http://www.commercial.carrier.com/commercial/hvac/productdescription . . . , "Carrier: i-Vu CCN," 1 page, printed Mar. 11, 2008.
http://www.commercial.carrier.com/commercial/hvac/productdescription . . . , "Carrier: 33CSCCNWEB-01 CCN Web Internet Connection to the Carrier Comfort Network," 1 page, printed Mar. 11, 2008.
http://www.docs.hvacpartners.com/idc/groups/public/documents/techlit/gs-controls-ivuccn.rtf, "Products," 5 pages, printed Jul. 3, 2007.
http://www.lightstat.com/products/istat.asp, Lightstat Incorporated, "Internet Programmable Communicating Thermostats," 1 page, printed Mar. 13, 2007.
http://www.sharpsystems.com/products/pc_notebooks/actius/rd/3d/, "Actius RD3D Desktop Replacement Notebook with Industry-Breakthrough 3D Screen," Sharp, 1 page, printed Jun. 16, 2005.
http://www2.sims.berkeley.edu/courses/is213/s06/projects/lightson;final.html, "Lights On A Wireless Lighting Control System," 11 pages, printed Mar. 22, 2007.
i.Lon 100e3 Internet Server, 1 page, prior to Aug. 27, 2007.
i.Lon, SmartServer, 2 pages, prior to Aug. 27, 2007.
i-stat, Demo Screen Shots, 9 pages, printed Mar. 13, 2007.
i-stat, The Internet Programmable Thermostat, 2 pages, prior to Aug. 27, 2007.

(56) References Cited

OTHER PUBLICATIONS

Jeffrey Ball, "Green Goal of 'Carbon Neutrality' Hits Limit," TheWall Street Journal, 7 pages, Dec. 30, 2008.
Johnson Controls, Network Integration Engine (NIE) 3 pages, Nov. 9, 2007.
Johnson Controls, Network Integration Engine (NIE), Product Bulletin, pp. 1-11, Jan. 30, 2008.
Kourti, Theodora, "Process Analysis and Abnormal Situation Detection: From Theory to Practice," IEEE Control Systems Magazine, p. 10-25, Oct. 2002.
Mathew, Paul A., "Action-Oriented Benchmarking, Using CEUS Date to Identify and Prioritize Efficiency Opportunities in California Commercial Buildings," 26 pages, Jun. 2007.
Morrison, Don et al., "The Early Event Detection Toolkit," Honeywell Process Solutions, 14 pages, Jan. 2006.
Narang, "WEBARC: Control and Monitoring of Building Systems Over the Web," 53 pages, May 1999.
Iuliana Bocicor et al. "Wireless Sensor Network based System for the Prevention of Hospital Acquired Infections", Arxiv.org, Cornell University Ithaca, NY 14853, May 2, 2017, XP080947042, (Abstract).
Shhedi Zaid Ali et al., "Traditional and ICT Solutions for Preventing the Hospital Acquired Infection", 2015 20th International Conference on Control Systems and Computer Science, IEEE, May 27, 2015, pp. 867-873, XP033188038.
Extended European Search Report, EP application No. 20151295.1, pp. 13, May 26, 2020.
U.S. Appl. No. 14/109,496, filed Dec. 17, 2013.
www.geappliances.com/home-energy-manager/about-energy-monitors.htm, "Energy Monitor, Home Energy Monitors, GE Nucleus," 2 pages, printed Jan. 15, 2013.
www.luciddesigngroup.com/network/apps.php#/homepage, "Lucid Design Group—Building Dashboard Network—Apps, " 7 pages, Jan. 15, 2013.
Preuveneers et al., "Intelligent Widgets for Intuitive Interaction and Coordination in Smart Home Environments," IEEE Eighth International Conference on Intelligent Environments, pp. 157-164, 2012.
Wu et al., "A Web 2.0 Based Scientific Application Framework," 7 pages, prior to Jul. 24, 2014.
"4.0 Today's Activities, The Home Dashboard," CRBM info@hand website, 46 pages, prior to Apr. 25, 2013.
"Free Facilities Dashboards," eSight Energy Website, 2 pages, prior to Apr. 25, 2013.
Alerton Building Controls, Gallery Prints, 7 pages, Dec. 19, 2013.
Carter, "Industrial Energy Management Dashboards Require a Toolkit," Cross Automation, 11 pages, Nov. 4, 2013.
U.S. Appl. No. 14/169,071, filed Jan. 30, 2014.
U.S. Appl. No. 14/169,083, filed Jan. 30, 2014.
U.S. Appl. No. 14/461,188, filed Aug. 15, 2014.
U.S. Appl. No. 14/482,607, filed Sep. 10, 2014.
e-homecontrols.com, "e-Home Controls Website," link to actual website no longer works, 1 page, prior to Dec. 19, 2013.
http://www.ccbac.com, "C&C (/)—Omniboard," 5 pages, Dec. 19, 2013.
http://www.domcontroller.com/en/, "DomController Home Automation Software—Control Anything from Anywhere," 11 pages, printed Jan. 6, 2015.
http://www.novar.com/ems-bas/opus-building-automation-system, "Novar OPUS BAS," 1 page, prior to Feb. 13, 2013.
Instituto Superior Tecnico, "A 3D Interactive Environment for Automated Building Control," Master's Dissertation, 120 pages, Nov. 2012.
Panduit Corp., "Enable a Building Automation with Panduit Enterprise Solutions," 4 pages, Nov. 2012.
"WEBs-AX Web-Enabled Building Solutions," sales brochure, Honeywell International Inc., Mar. 2009.
"Attune Advisory Services," press release, Honeywell International Inc., Mar. 20, 2012.
enteliWEB product from Delta Controls, web pages retrieved on May 9, 2013 from http://deltacontrols.com/products/facilities-management/supervisory-software et seq. by the Internet Archive at web.archive.org.
"BACnet Protocol Implementation Conformance Statement" for enteliWEB, Delta Controls, Jul. 17, 2013.
Castle, "7 Software Platforms that Make Building Energy Management Easy," http://greentechadvocates.com/2012/11/28/7-software-platforms-that-make-building-energy-managment-easy/, Nov. 28, 2012.
enteliWEB catalog sheet, Delta Controls, Inc., 2012.
enteliWEB catalog sheet, Delta Controls., 2010.
"Intelligent Building Management Systems in Miami," Advanced Control Corp., Mar. 7, 2013.
"The Ohio State University," BACnet International Journal, vol. 5, p. 4, Jan. 2013.
Bobker et al., "Operational Effectiveness in Use of BAS," Proceedings of the 13th International Conference for Enhanced Building Operations, Oct. 8, 2013.
Castelo, "A 3D Interactive Environment for Automated Building Control," Elsevier, Nov. 8, 2012.
"Creston Special Report: How Intelligent building management solutions are reducing operational costs," Creston, 2012.
"Building Automation Software Solutions," Iconics, 2013.
Lacey, "The Top 10 Software Vendors Connecting Smart Buildings to the Smart Grid," http://www.greentechmedia.com/articles/read/the-top-10-companies-in-enterprise-smart-grid, Jul. 18, 2013.
"NiagraAX Product Model Overview," Tridium, Inc., 2005.
"An Overview of NiagraAX: A comprehensive software platform designed to create smart device applications," Tridium, Inc., 2005.
"Phoenix Controls Portal," Phoenix Controls, Inc., 2013.
Quirk, "A Brief History of BIM," Arch Daily, Dec. 7, 2012.
Samad et al., "Leveraging the Web: A Universal Framework for Building Automation," Proceedings of the 2007 American Control Conference, Jul. 11, 2007.
Sinha et al., "9 Key attributes of energy dashboards and analytics tools," https://www.greenbiz.com/blog/2013/08/28/9-key-attributes-energy-dashboards-and=analytics-tools, Aug. 28, 2013.
Sinopoli, "Dashboards For Buildings," http://www/automatedbuildings.com/news/dec10/articles/sinopoli/101119034404sinopoli.html, Dec. 2010.
Sinopoli, "Modeling Building Automation and Control Systems," http://www.automatedbuildings.com/news/jun13/articles/sinopoli/130521122303sinopoli.html, Jun. 2013.
Zito, "What is Tridium Part 1," http://blog.buildingautomationmonthly.com/what-is-tridium/, May 12, 2013.
Zito, "What is Tridium Part 2," http://blog.buildingautomationmonthly.com/tridium-part-2/, Sep. 10, 2013.
Search Report and Written Opinion from related International PCT Application No. PCT/US2018/025189 dated Jul. 17, 2018 (12 pages).
"Data analytics and smart buildings increase comfort and energy efficiency", https://www.microsoft.com/itshowcase/Article/Content/845/Data-analytics-and-smart-buildings-increase-comfort-and-energy-efficiency, Dec. 19, 2016, 8 pages.
Donnelly, "Building Energy Management: Using Data as a Tool", http://www.buildingefficiencyinitiative.org/sites/ default/files/legacy/InstituteBE/media/Library/Resources/Existing-Building-Retrofits/Using-Building-Data-as-a-Tool.pdf, Oct. 2012, 9 pages.
"ASHRAE Dashboard Research Project," 29 pages, Aug. 28, 2008.
Olken et al., "Object Lessons Learned from a Distributed System for Remote Building Monitoring and Operation," ACM SIGPLAN Notices, vol. 33, No. 10, pp. 284-295, Oct. 1998.
Proliphix, Inc., "Proliphix IP Devices: HTTP API," 28 pages, Jan. 23, 2006.
Proliphix, Inc., Remote Management User Guide, 12 pages, prior to Aug. 27, 2007.
Richard Rogan et al., "Smart and Final Food Stores: A Case Study in Web Based Energy Information and Collection," Web Based Energy Information and Control Systems: Case Studies and Application, Chapter 6, p. 59-64, 2005.
Sharp, "Actius AL3DU 3D LC Display High Performance 3D Visualization," 2 pages, prior to Mar. 17, 2006.

(56) References Cited

OTHER PUBLICATIONS

So et al., "Building Automation on the Information Superhighway," ASHRAE (American Society of Heating Refrigerating, and Air Conditioning) Transactions, vol. 104, Part 2, pp. 176-191, 1998.
So et al., "Building Automation Systems on the Internet," Facilities vol. 15, No. 5/6, pp. 125-133, May/Jun. 1997.
Talon, "Raptor Controller," 6 pages, Oct. 2003.
Talon, "Workstation Software," 4 pages, Nov. 2002.
Trane, "System Programming, Tracer Summit Version 14, BMTW-SVP01D-EN," 623 pages, 2002.
Lucid Design Group, Inc., "Building Dashboard," 2 pages, Printed May 30, 2013.
"America's Largest Managed Security Services Provider Launches Comprehensive, Integrated Covid-19 Safety Program for Office Buildings and Suites," KastleSafeSpaces, 5 pages, May 11, 2020.
"Biometric Door Reader With Body Temperature Detection," Kintronics, 9 pages, accessed May 21, 2020.
"Body Surface Temperature Screening with Alarm Function TVS-200IS/TVS-5O0IS," Nippon Avionics Co., 3 pages, accessed May 21, 2020.
"BriefCam announces video analytics innovation for contact tracing, physical distancing, occupancy management and face mask detection," BriefCam LTD, 11 pages, Jun. 5, 2020.
"Thermal Imaging SmartPhone Can Be used For Temperature Screening of People," CAT, 3 pages, accessed Jul. 13, 2020.
"Contact Tracing Now Available on Identiv's Hirsch Velocity Access Control Platform," Identiv, 5 pages, May 21, 2020.
Silva et al., "Cough localization for the detection of respiratory diseases in pig houses," ScienceDirect, 7 pages, May 28, 2008.
Oey et al., "Evaluation of Isolation Compliance Using Real Time Video In Critical Care," North Shore University Hospital, 1 page, Oct. 9, 2015.
"Facial Attendace System With Temperature Screening Now In India," IANS, 5 pages, Mar. 19, 2020.
"Plan to Re-Open," EHIGH, 16 pages, accessed Jun. 13, 2020.
"How Smarter AI-Powered Cameras Can Mitigate the Spread of Wuhan Novel," AnyConnect, 22 pages, 2020.
"How to fight COVID-19 with machine learning," DataRevenue, 20 pages, accessed May 25, 2020.
"INNCONTROL 5," Honeywell, 2 pages, Aug. 8, 2018.
"IP Door Access Control," Kintronics, 21 pages, 2014.
"Kogniz Al Health Response Platform," Kogniz, 9 pages, accessed May 21, 2020.
"Machine Learning Could Check If You're Social Distancing Properly at Work," MIT Technology Review, 7 pages, Apr. 17, 2020.
Punn et al., "Monitoring COVID-19 social distancing with person detection and tracking via fine-tuned YOLO v3 and Deepsort techniques," 10 pages, May 6, 2020.
Burt, "NEC launches dual face biometric and fever detection system for access control," Biometric Update, 4 pages, May 8, 2020.
"Remote temperature monitoring," AXIS Communication, 10 pages, 2014.
"FebriEye-Al Based Thermal Temperature Screening System," vehant, 1 page, 2020.
"See The World In A New Way Hikvision Thermal Cameras," Hikvision, 12 pages, 2017.
Allain, "Trying out the iPhone Infrared Camera: The FLIR One," Wired, 15 pages, 2014.
Dasgupta, "Your voice may be able to tell you if you have Covid," Hindustan Times, 4 pages, Apr. 16, 2020.
Ganguty, "Gurugram-based startup Staqu has modified AI-powered JARVIS to battle coronavirus," Yourstory, 7 pages, Mar. 31, 2020.
"White Paper Usage of D6T-44L/D6T-8L Thermal Sensor," OMRON Corporation, 18 pages, 2013.
"MEMS: Thermal Sensors-D6T," OMRON C Electronic Components LLC, 7 pages, Nov. 2012.
Extended European Search Report EP Application No. 20217467.8-1205, May 28, 2021 (6 pages).
Zhang et al.; "Real-Time Human Motion Behavior Detection via CNN Using mmWave Radar," IEEE Sensors Council, 4 pages, Feb. 2019.
"A Sensor Above the Rest," VAYYAR, 6 pages, accessed Oct. 7, 2020.
Thakur, "Infrared Sensors for Autonomous Vehicles," Intech Open, 17 p. 2018.
"Presence Sensing", 1 page, accessed Jul. 21, 2021.
Trane, "Creating Input/Output Objects," 196 pages, retrieved Jul. 10, 2020.
Trane, "Using the Graphing Control Editor," 181 pages, retrieved Jul. 10, 2020.

* cited by examiner

MULTI-SENSOR PLATFORM FOR A BUILDING

PRIORITY DATA

This application is a continuation of International Application No. PCT/CN2021/121137, filed Sep. 28, 2021, the contents of which are herein incorporated by reference in their entirety.

TECHNICAL FIELD

The present disclosure pertains generally to sensing assemblies and more particularly to multiple sensor sensing assemblies for a building.

BACKGROUND

Sensors are used to sense a variety of different conditions in a variety of different applications. In building management system (BMS) applications, for example, sensors may be used to sense environmental conditions such as temperature, humidity and various measures of indoor air quality. Alternatively, or in addition, sensors may be used to sense, for example, occupancy of a building space, security events occurring in or around a building space, and/or other abnormal events such as equipment failure occurring in a building space. A need remains for improved sensor assemblies that can be used to support the operation of building management systems.

SUMMARY

This disclosure relates generally to sensing assemblies and more particularly to multiple sensor sensing assemblies. In an example, a multiple sensor sensing assembly provides the opportunity to mix and match particular sensors for particular applications or use-cases, including some universal sensors on a baseboard and additional application specific sensors as desired on one or more daughterboards. In some cases, the multiple sensor sensing assembly may efficiently use artificial intelligence (AI) to locally synthesize or fuse outputs from various ones of the sensors to produce one or more output parameters that can be reported to a remote device such as a remote server.

A particular example may be found in a sensing assembly having a housing with mounting features for mounting the housing to a mounting surface of a building. This example sensing assembly includes a baseboard that is housed by the housing as well as a daughterboard that is housed by the housing and is operably coupled with the baseboard. The baseboard includes a microcontroller unit (MCU) that is mounted to the baseboard and two or more sensors that are mounted to the baseboard. The MCU includes a packaged integrated circuit die that has a central processing unit (CPU) and a non-volatile memory that is operably coupled to the CPU and that stores a Real Time Operating System (RTOS) and an embedded Artificial Intelligence (AI) code for execution by the CPU. The integrated circuit die also includes an I/O port. The two or more sensors mounted to the baseboard are operatively coupled to the I/O port of the MCU and include two or more of a temperature sensor, a humidity sensor, an ambient light sensor, and a microphone.

The daughterboard includes two or more sensors that are mounted to the daughterboard, including an IR sensor and a time of flight (TOF) sensor. The housing defines a window that exposes the IR sensor and the TOF sensor to a space in the building that is external of the housing. The MCU of the baseboard is configured to receive an output signal from each of the two or more sensors mounted to the daughterboard and the two or more sensors mounted to the baseboard, process two or more of the output signals using the embedded AI code to produce one or more output parameters and output the one or more output parameters via the I/O port of the MCU to the baseboard.

Another example may be found in a sensing assembly that includes a baseboard and a daughterboard that is operatively coupled to the baseboard. In this example, the baseboard includes a microcontroller unit (MCU) mounted to the baseboard, the MCU executing a Real Time Operating System (RTOS) and embedded Artificial Intelligence (AI) code, and two or more sensors that are mounted to the baseboard and operatively coupled to the MCU, the two or more sensors including two or more of a temperature sensor, a humidity sensor, an ambient light sensor, and a microphone. The daughterboard includes two or more sensors that are mounted to the daughterboard. The MCU of the baseboard is configured to receive an output signal from each of the two or more sensors mounted to the daughterboard and the two or more sensors mounted to the baseboard and to process two or more of the output signals using the embedded AI code to produce one or more output parameters. The baseboard includes communication circuitry for communicating one or more of the output parameters to a remote device such as a remote server.

Another example may be found in a method of assembling a sensing assembly. In this example, a housing is selected from a first housing and a second housing, wherein the first housing includes a sensor window that is orientated in a first orientation relative to a mounting surface, and the second housing includes a sensor window that is orientated in a second orientation relative to the mounting surface. A baseboard is installed in the selected housing. The baseboard includes a microcontroller unit (MCU) mounted to the baseboard, the MCU including a packaged integrated circuit die, wherein the integrated circuit die includes a central processing unit (CPU), an I/O port and a non-volatile memory operatively coupled to the CPU. The non-volatile memory stores a Real Time Operating System (RTOS) and an embedded Artificial Intelligence (AI) code for execution by the CPU. Two or more sensors are mounted to the baseboard and are operatively coupled to the I/O port of the MCU, the two or more sensors including two or more of a temperature sensor, a humidity sensor, an ambient light sensor, and a microphone.

A daughterboard is installed in the selected housing and operatively coupling the daughterboard to the baseboard, wherein the daughterboard includes two or more sensors mounted to the daughterboard. The first housing, when selected, supports the daughterboard in an orientation where at least one of the two or more sensors mounted to the daughterboard are orientated toward and aligned with the sensor window of the first housing. The second housing, when selected, supports the daughterboard in an orientation where at least one of the two or more sensors mounted to the daughterboard are orientated toward and aligned with the sensor window of the second housing.

The preceding summary is provided to facilitate an understanding of some of the features of the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments of the disclosure in connection with the accompanying drawings, in which.

Figure 1:
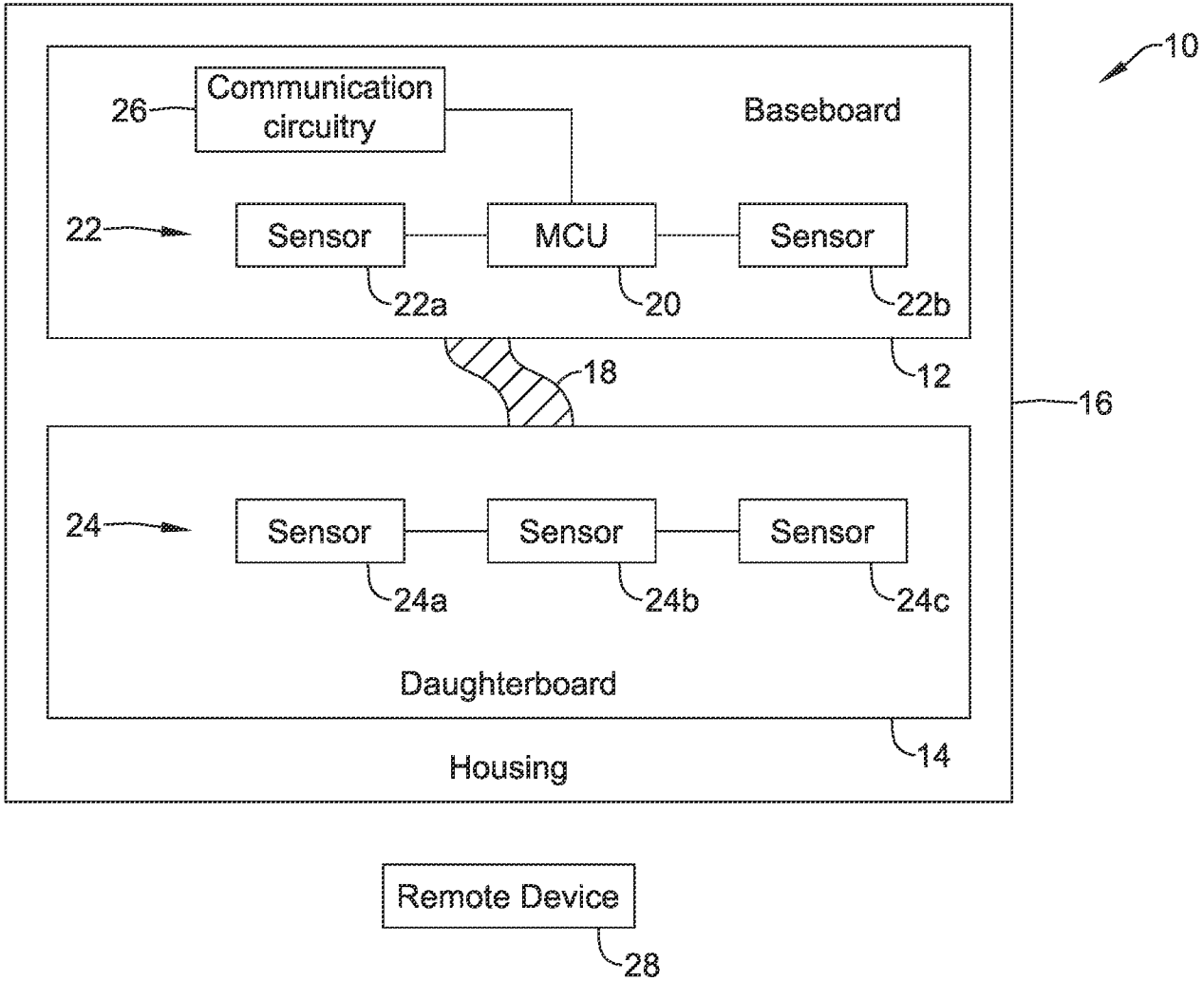
FIG. 1 is a schematic block diagram of an illustrative sensing assembly.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

FIG. 1 is a schematic block diagram of an illustrative sensing assembly 10. The illustrative sensing assembly 10 includes a baseboard 12 and a daughterboard 14 that is operatively coupled with the baseboard 12. While a single daughterboard 14 is shown, it will be appreciated that in some instances there may be two, three or more daughterboards 14 operatively coupled with the baseboard 12. In some instances, the baseboard 12 may be considered as being a motherboard. The baseboard 12 and the daughterboard 14 are both disposed within a housing 16 and are operatively coupled via a flexible ribbon connector 18 that extends between the baseboard 12 and the daughterboard 14. While not shown, the baseboard 12 and the daughterboard 14 may each include a connector port to which the flexible ribbon connector may be electrically and mechanically coupled in order to operatively couple the baseboard 12 and the daughterboard 14.

In the example shown, the baseboard 12 includes an MCU 20, which is a microcontroller unit. The baseboard 12 also includes two or more sensors 22, individually labeled as 22*a* and 22*b*, that are operatively coupled with the MCU 20. While two sensors 22 are shown, in some instances the baseboard 12 may include any number of sensors, including one sensor 22, three sensors 22, four sensors 22, or any greater number of sensors 22. At least some of the two or more sensors 22 may include MEMS sensors, for example. The two or more sensors 22 may include any variety of sensors, including but not limited to a temperature sensor, a humidity sensor, an ambient light sensor, an accelerometer, and a microphone. In some cases, the baseboard 12 may additionally or alternatively include sensors such as a vibration sensor or another surface mountable IMU (Inertia Measurement Unit) sensor. An IMU is an electronic device that measures and reports a body's specific force, angular rate, and sometimes the orientation of the body, using a combination of accelerometers, gyroscopes and optionally magnetometers. It will be appreciated that the two or more sensors 22, in combination with the MCU 20, will give the baseboard 12 a certain level of sensing ability and functionality. In some cases, the two or more sensors 22 on the baseboard may be considered to be universal sensors that have application across multiple use cases.

The daughterboard 14 may be considered as providing additional sensing ability and functionality to that provided by the baseboard 12. In some cases, the daughterboard 14 may include application specific sensors that are directed at one or more specific use-cases, but this is not required. In some cases, various different daughterboard 14 each having different sensor combinations may be made available, and a particular one of the different daughterboards may be selected and installed in the sensing assembly 10 depending on the specific use-case at hand.

In the example shown, the daughterboard 14 may include two or more sensors 24, individually labeled as 24*a*, 24*b* and 24*c*. While three sensors 24 are shown, in some instances the daughterboard 14 may include any number of sensors 24, including one sensor 24, two sensors 24, four sensors 24 or any greater number of sensors 24. At least some of the two or more sensors 24 may include MEMS sensors, for example. The two or more sensors 24 may include any variety of sensors including, for example, occupancy sensors and environmental sensors.

Examples of suitable occupancy sensors include but are not limited to IR sensors (such as passive infrared (PIR) sensors) and time of flight (TOF) sensors. Examples of suitable environmental sensors include but are not limited to a temperature sensor, a humidity sensor, a carbon dioxide ($CO_2$) sensor, a carbon monoxide (CO) sensor, a total Volatile Organic Compound (VOC) sensor and a particulate matter (PM) sensor. In some cases, a carbon monoxide (CO) sensor may be used in a standalone daughterboard for use in areas that may be prone to accumulation of hazardous gases such as CO. An underground parking structure is an example of where a CO sensor may be beneficial.

In some instances, a first daughterboard 14 may be equipped as an occupancy card, and thus may include occupancy sensors (e.g. PIR, TOF, micro-LIDAR, mmWave Indoor Radar). A second daughterboard 14 may be equipped as an environmental card, and thus may include environmental sensors. A person assembling the sensing assembly 10 may use the first daughterboard 14 in order to give the sensing assembly 10 occupancy sensing capabilities. Alternatively, or in addition, a person assembling the sensing assembly 10 may use the second daughterboard 14 in order to give the sensing assembly 10 environmental sensing capabilities. If the housing 16 and the baseboard 12 will accommodate more than one daughterboard 14, the person assembling the sensing assembly 10 could include both the first daughterboard 14 and the second daughterboard 14 in order to give the sensing assembly 10 both occupancy sensing capability and environmental sensing capability. These are just examples.

In the example shown, the MCU 20 is configured to receive an output signal from each of the two or more sensors 24 of the daughterboard 14 and to receive an output signal from each of the sensors 22 of the baseboard 12. The MCU 20 is configured to process two or more of the output signals using embedded artificial intelligence (AI) code to produce one or more output parameters. The baseboard 12 includes communication circuitry 26 that is operably coupled with the MCU 20. The MCU 20 is able to communicate one or more of the output parameters to a remote device 28 via the communication circuitry 26. The remote device 28 may be a computer such as a desktop or a laptop, or perhaps a cloud-based server. The remote device 28 may be a mobile device such as a tablet or a smartphone, for example.

In some instances, the one or more output parameters may include one or more occupancy parameters. Examples of occupancy parameters include but are not limited to human presence, people count, people flow and people tracking. The one or more output parameters may include one or more environmental parameters. Examples of environmental parameters include but are not limited to noise, illuminance (light level) and Indoor Air Quality (IAQ). In some instances, the one or more output parameters may include one or more anomaly detection parameters. Examples of anomaly detection parameters may include but are not limited to an anomalous audio, an anomalous pressure, an anomalous temperature, an anomalous humidity, an anomalous ambient light, an anomalous vibration, an anomalous people presence, an anomalous people count, and an anomalous people flow.

In some cases, the MCU 20 is configured to identify one or more events and/or faults based at least in part on the one or more anomaly detection parameters. The embedded AI may be configured to learn to detect anomalies based at least in part on one or more of the processed output signals from the various sensors. In some cases, the embedded AI may be configured to learn over-time what is considered "anomalous" in the particular building to which the sensing assembly 10 is installed. In some cases, anomalous parameters may be communicated to the remote device 28 and not all sensor data, thereby reducing the amount of sensor data that is transmitted to the remote device 28. This can significantly reduce the bandwidth required for the communication channel to the remote device 28.

Figure 2:
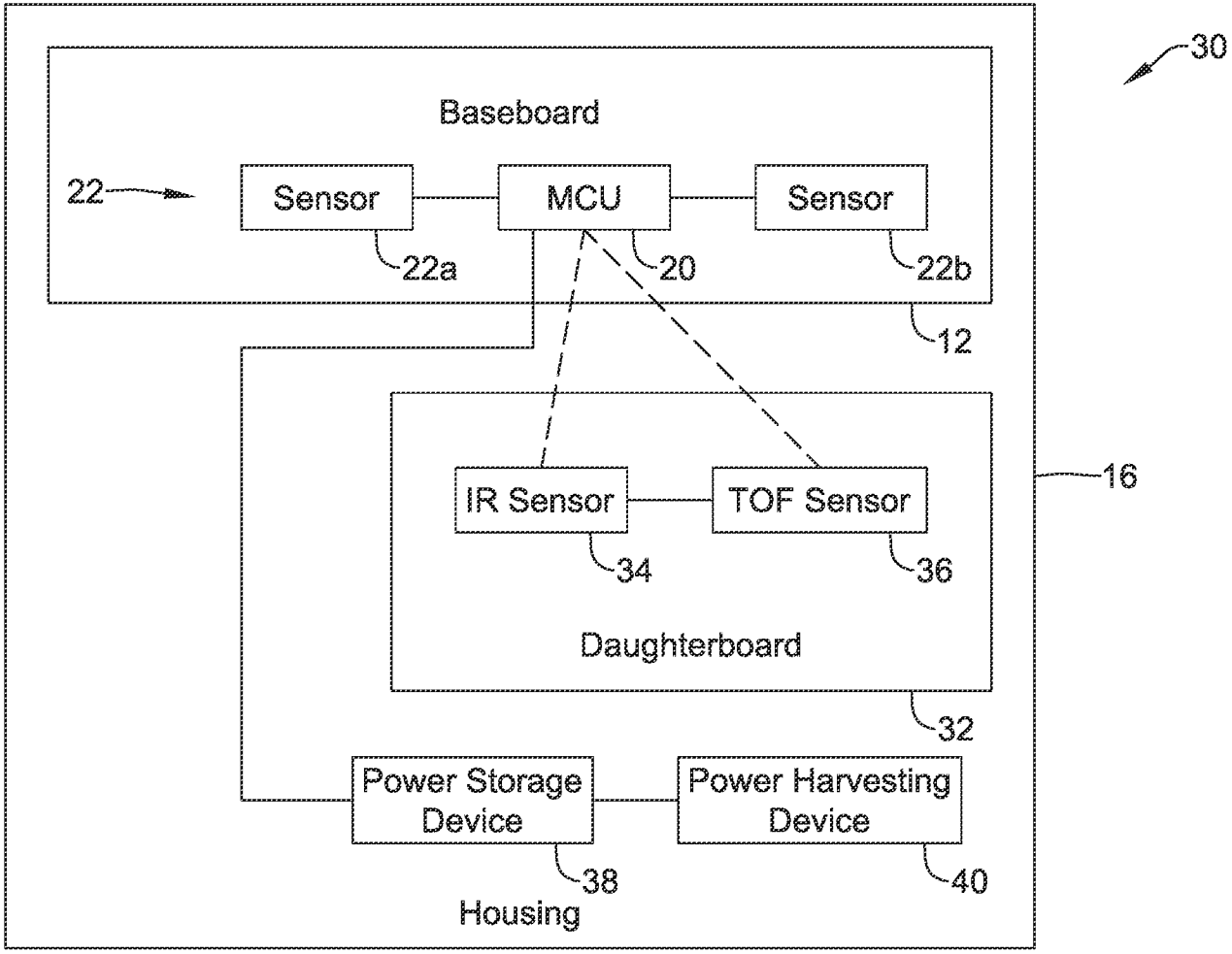
FIG. 2 is a schematic block diagram of an illustrative sensing assembly.

FIG. 2 is a schematic block diagram of an illustrative sensing assembly 30 that includes the same baseboard 12 as the sensing assembly 10, but includes a daughterboard 32 that has an IR sensor 34 and a TOF sensor 36. The sensing assembly 30 may include components discussed with respect to the sensing assembly 10 and the sensing assembly 10 may include components discussed with respect to the sensing assembly 30. In some cases, the IR sensor 34 may consume a low level of electrical power while the TOF sensor 36 may consume a relatively greater level of electrical power that could prevent the sensing assembly 30 from being battery powered with a reasonable lifetime if the TOF sensor 36 was always enabled, for example. In some cases, the IR sensor 34 may be configured to be powered on all of the time while the TOF sensor 36 is only powered on when the IR sensor 34 indicates movement or the possible presence of a person, for example.

In some cases, the IR sensor 34 may have a field of view (FOV) that overlaps a FOV of the TOF sensor 36. The TOF sensor 36 may have a FOV that is smaller than the FOV of the IR sensor 34, and thus when activated, can be considered to "zoom in" to a particular region of the FOV of the IR sensor 34. In some cases, the TOF sensor 36 has a power savings mode and a sensing mode, wherein after a period of no activity the MCU 20 may set the TOF sensor 36 to the power savings mode, and in response to the IR sensor detecting activity, the MCU 20 may set the TOF sensor 36 to the sensing mode.

In the example shown, the sensing assembly 30 may include a power storage device 38 that may be used to power the sensing assembly 30. The power storage device 38 may be a battery such as a rechargeable battery or a single-charge battery. The power storage device 38 may be a capacitor, for example. In some cases, the sensing assembly 30 may include a power harvesting device 40 that allows the sensing assembly 30 to capture at least some the power necessary to recharge the power storage device 38 and/or operate the sensing assembly 30 from its environment. As an example, the power harvesting device may be or otherwise include a solar cell that can generate electrical power from incident light. The sensing assembly 10 (FIG. 1) may include one or both of the power storage device 38 and the power harvesting device 40. In some cases, the sensing assembly 10 and/or sensing assembly 29 may be powered by line-power, with or without a backup power source. The sensing assembly 30 (FIG. 2) may include the communication circuitry 26. These are just examples.

Figure 3:
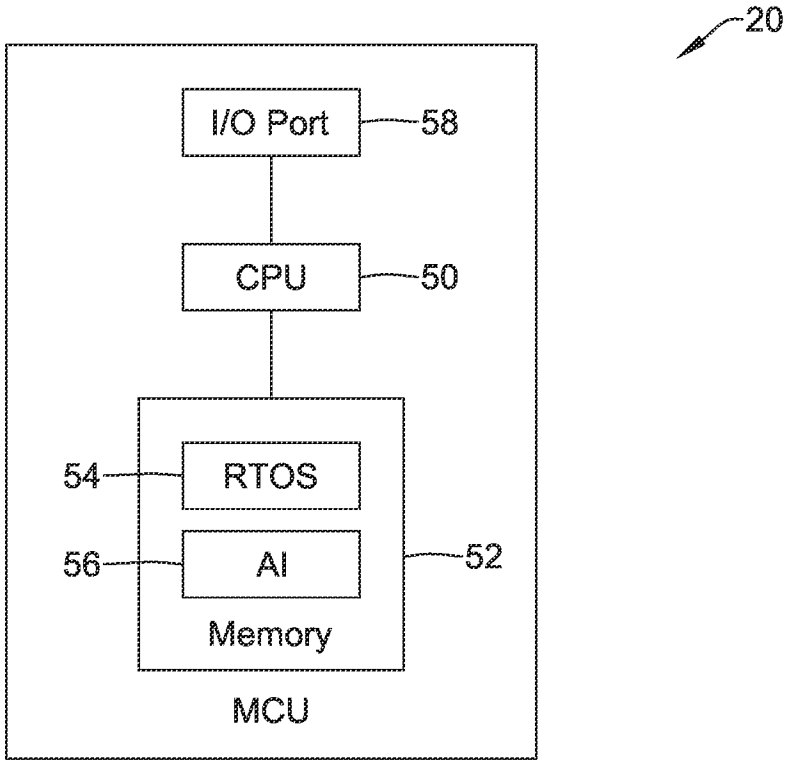
FIG. 3 is a schematic block diagram of an illustrative microcontroller unit (MCU) usable in the illustrative sensing assembly of FIG. 1 or the illustrative sensing assembly of FIG. 2.

FIG. 3 is a schematic block diagram showing the MCU 20. In some instances, the MCU 20 is a packaged integrated circuit die that includes a central processing unit (CPU) 50 and a non-volatile memory 52 that is operatively coupled to the CPU 50. The non-volatile memory 52 stores for execution by the CPU 50 a Real Time Operating System (RTOS) 54 and an embedded Artificial Intelligence (AI) code 56. The example MCU 20 also includes an I/O port 58. The I/O port 58 allows the MCU 20 to communicate with the sensors 22 that are mounted on the baseboard 12 as well as with the sensors 24 that are mounted on the daughterboard 14. The I/O port 58 may also allow the MCU 20 to communicate with the remote device 28 sometimes through a communication circuitry 26 on the baseboard 12.

In some instances, the baseboard 12 may be configured to receive an update or replacement to the embedded Artificial Intelligence (AI) code 56 via the communication circuitry 26 and to update or replace the embedded Artificial Intelligence (AI) code 56 that is stored in the non-volatile memory 52 with the updated or replacement embedded Artificial Intelligence (AI) code. The non-volatile memory 52 may further store one or more drivers for communicating with one or more of the sensors 24. The baseboard 12 may be configured to receive an update or replacement of one or more of the drivers via the communication circuitry 26 and update or replace one or more of the drivers stored in the non-volatile memory 52 with one or more of the updated or replacement drivers. The embedded Artificial Intelligence (AI) code 56 and/or the one or more drivers may be updated automatically or by an installer, depending on the sensors that are on the baseboard 12 and/or daughterboard 14 and the particular use-case of the sensing assembly 10 in the field. Such an update may be pushed to the sensing assembly 10 from, for example, a mobile device such as an installer's mobile phone, from a remote server such as a remote cloud server, and/or in any other suitable manner.

Figure 4A:
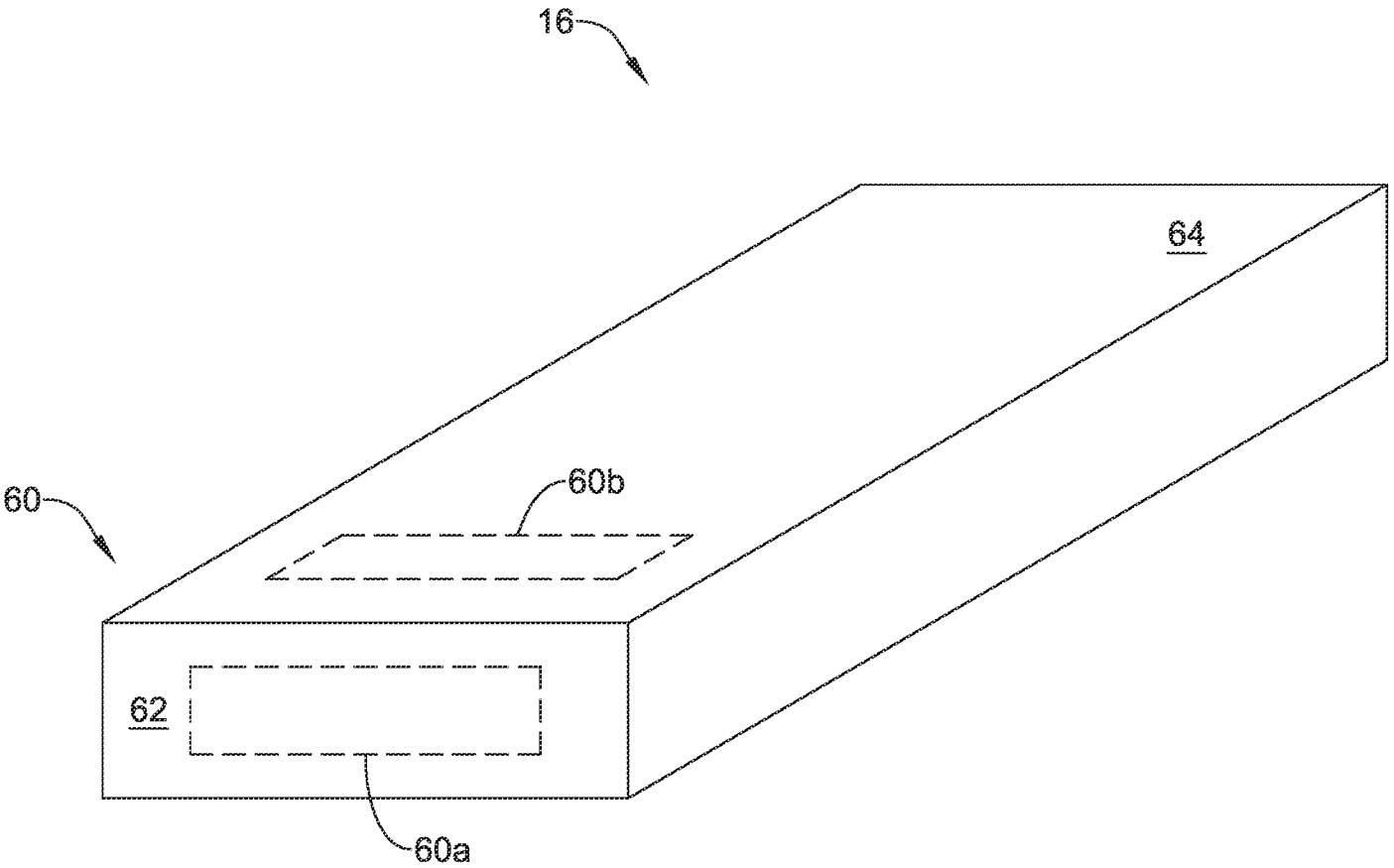
FIG. 4A is a top perspective view of an illustrative housing usable in the illustrative sensing assembly of FIG. 1 or the illustrative sensing assembly of FIG. 2.
Figure 4B:
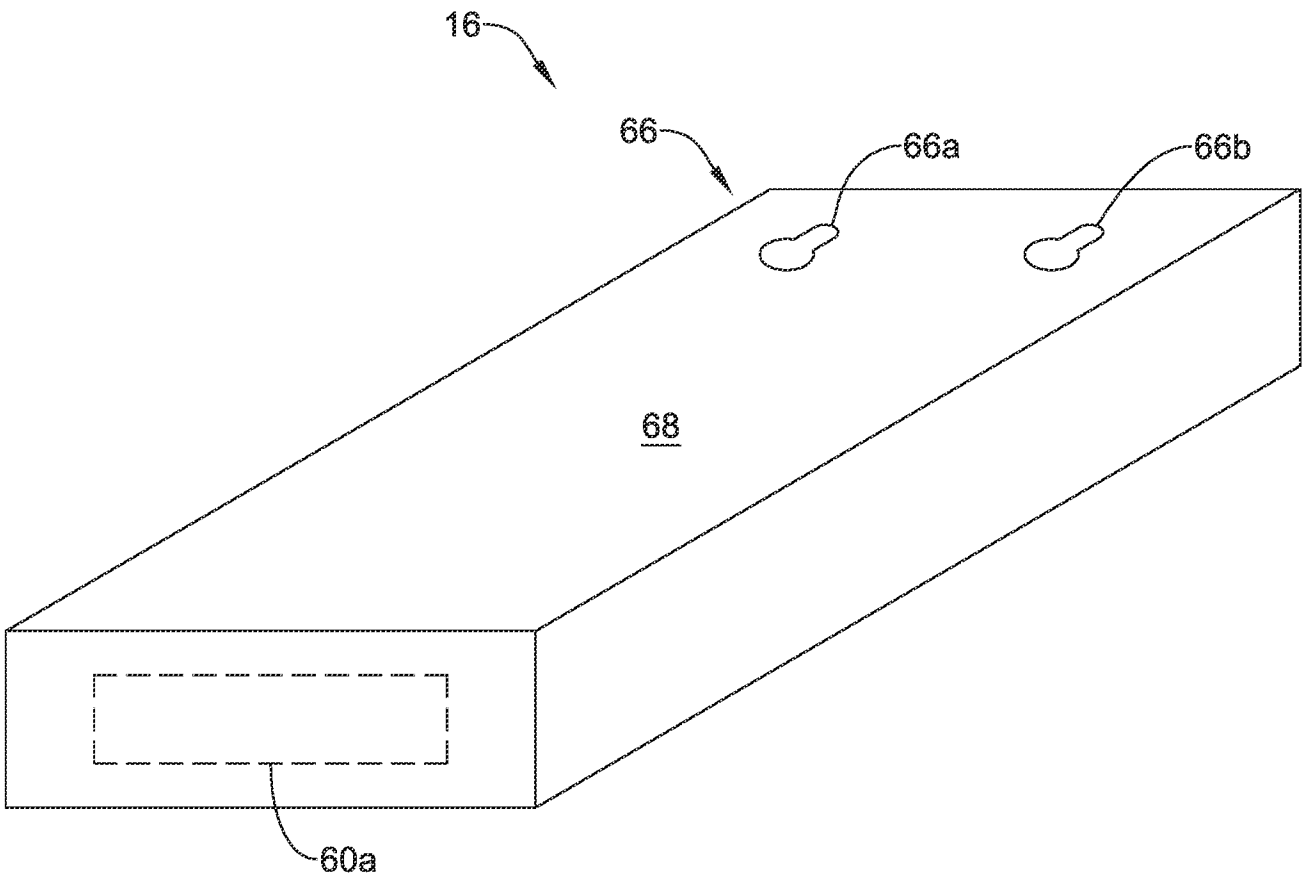
FIG. 4B is a bottom perspective view of the illustrative housing shown in FIG. 4A.

FIG. 4A is a top perspective view of an illustrative housing 16, and FIG. 4B is a bottom perspective view thereof. While the housing 16 is shown as being rectilinear, this is merely illustrative. The housing 16 may be circular, for example. In some cases, the housing 16 may be largely rectilinear, but may have rounded over corners and edges, for example. The housing 16 is sized to accommodate both the baseboard 12 and the daughterboard 14, 32 therein. The housing 16 may include one or more windows 60 formed within the housing 16. For example, the housing 16 may include a window 60*a* that is formed in a side wall 62 of the housing 16. In another example, the housing 16 may include a window 60*b* that is formed in a front surface 64 of the housing 16. It is contemplated that a particular housing may be selected for the sensing assembly dependent on the expected mounting orientation of the sensing assembly (e.g. on a wall surface, a ceiling surface or a door frame). In another example, the housing 16 may include a window 60*a* that is formed in a side wall 62 of the housing 16 and another window 60*b* that is formed in a front surface 64 of the housing 16. The size, shape and location of the window(s) may be dependent on the particular daughterboard(s) that is selected for inclusion in the housing 16. These are just examples.

It is contemplated that the windows 60 may or may not include an aperture or slot that extends through the material forming the housing 16. In some cases, the windows 60 may include a transparent or substantially transparent to whatever ranges of electromagnetic radiation are used by the sensors 24 of the housed baseboard and/or daughterboard. The windows 60 may be formed of a different material than the rest of the housing 16, for example, or may be open slots or apertures that extend through the housing wall to expose the underlying sensors directly to the environment outside of the housing 16.

The illustrative housing 16 also includes mounting features 66 that are disposed relative to a back surface 68 of the housing 16. The back surface 68 may be considered as the surface that is intended to contact a mounting surface of the building. The mounting surface may be a wall surface, a ceiling surface or even a door frame, for example. The mounting features 66 are generically shown, and may include any of a variety of different mounting technologies. In some cases, the mounting features 66 may be tapered holes that are meant to fit over a screw head and then slide down. Other mounting techniques are also contemplated.

Figure 5:
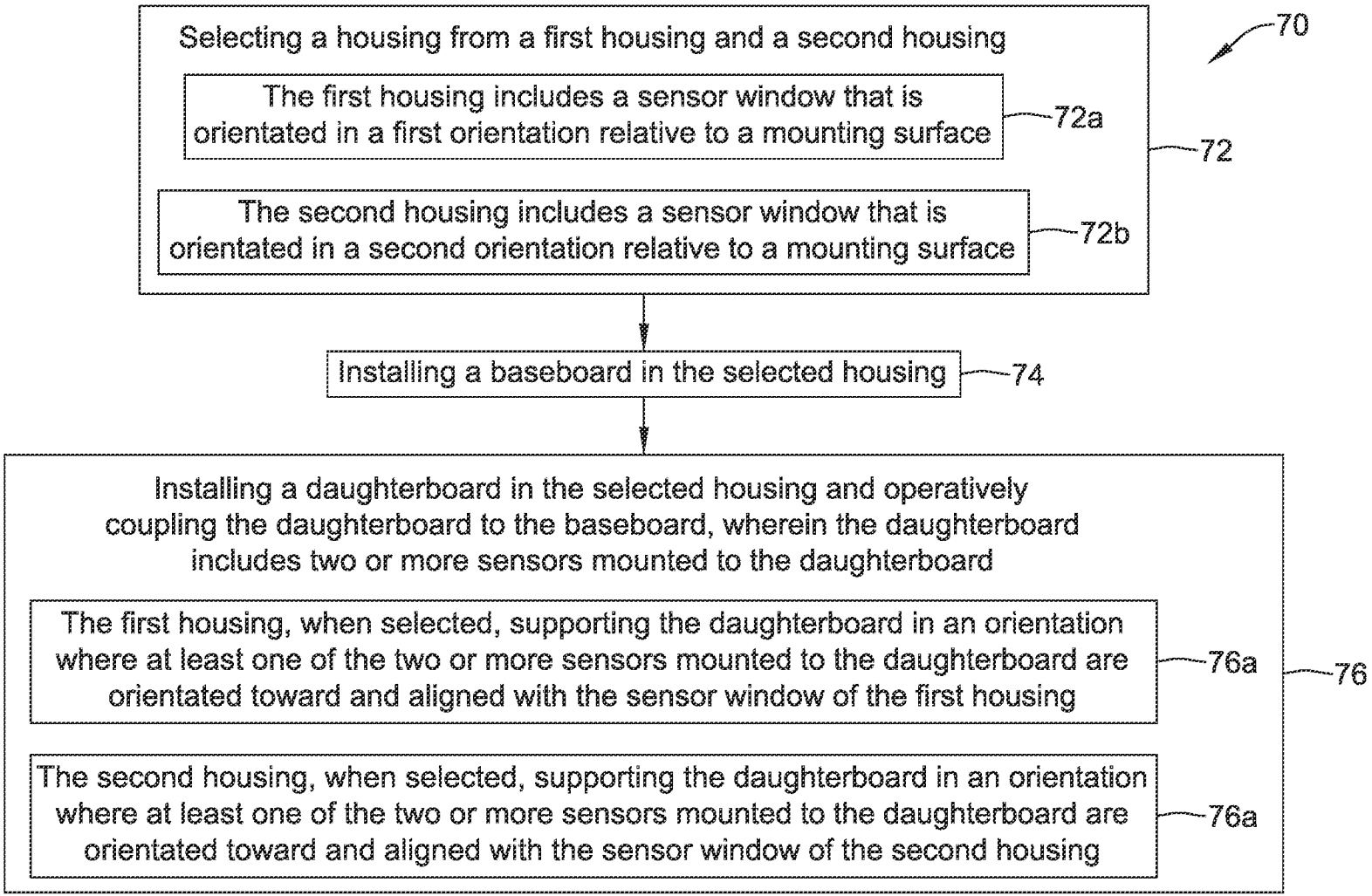
FIG. 5 is a flow diagram showing an illustrative method of assembling a sensing assembly such as the illustrative sensing assembly of FIG. 1 or the illustrative sensing assembly of FIG. 2.

FIG. 5 is a flow diagram showing an illustrative method 70 of assembling a sensing assembly (such as the sensing assembly 10 or the sensing assembly 30). A housing is selected from a first housing and a second housing, as indicated at block 72. The first housing includes a sensor window that is orientated in a first orientation relative to a mounting surface, as indicated at block 72*a*. The second housing includes a sensor window that is orientated in a second direction (different from the first direction) relative to the mounting surface, as indicated at block 72*b*.

In some cases, the first housing includes two opposing major surfaces (such as the front surface 64 and the back surface 68) with sidewalls (such as the side wall 62) extending between the two opposing major surfaces, and wherein the sensor window of the first housing extends along one of the two opposing major surfaces. The second housing may include two opposing major surfaces (such as the front surface 64 and the back surface 68) with sidewalls (such as the side wall 62) extending between the two opposing major surfaces, and wherein the sensor window of the second housing extends along one of the sidewalls.

A baseboard (such as the baseboard 12) is installed in the selected housing, as indicated at block 74. A daughterboard (such as the daughterboard 14, 32) is installed in the selected housing and is operatively coupled to the baseboard, wherein the daughterboard includes two or more sensors mounted to the daughterboard, as indicated at block 76. The first housing, when selected, supports the daughterboard in an orientation where at least one of the two or more sensors mounted to the daughterboard are orientated toward and aligned with the sensor window of the first housing, as indicated at block 76*a*. The second housing, when selected, supports the daughterboard in an orientation where at least one of the two or more sensors mounted to the daughterboard are orientated toward and aligned with the sensor window of the second housing, as indicated at block 76*b*.

Figure 6:
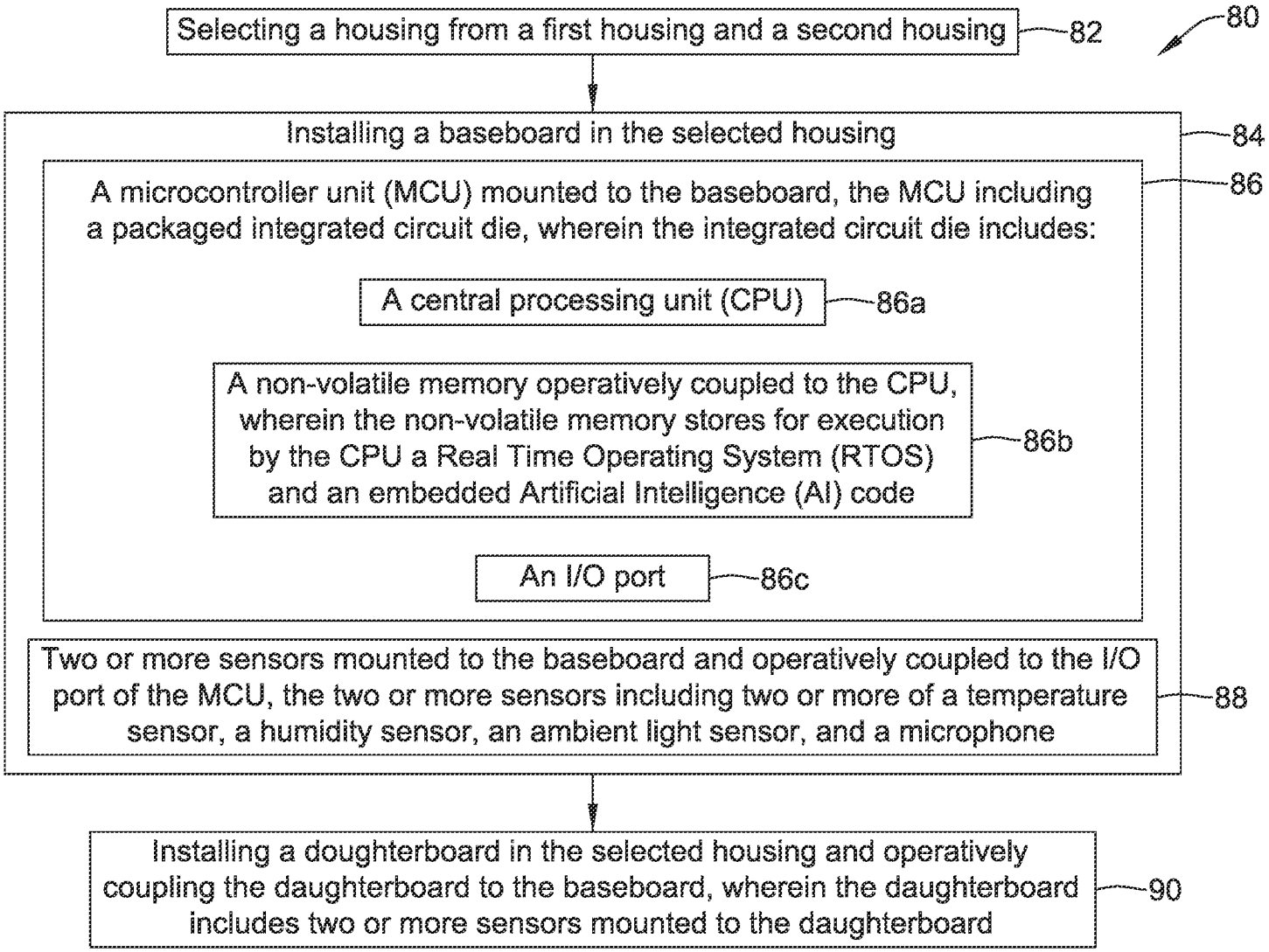
FIG. 6 is a flow diagram showing an illustrative method of assembling a sensing assembly such as the illustrative sensing assembly of FIG. 1 or the illustrative sensing assembly of FIG. 2.

FIG. 6 is a flow diagram showing an illustrative method 80 of assembling a sensing assembly (such as the sensing assembly 10 or the sensing assembly 30). A housing is selected from a first housing and a second housing, as indicated at block 82. The first housing and the second housing may be similar to those described with respect to FIG. 6. A baseboard (such as the baseboard 12) is installed in the selected housing, as indicated at block 84. The baseboard includes an MCU (such as the MCU 20) that is a packaged integrated circuit die, as indicated at block 86. The MCU includes a central processing unit (CPU), as indicated at block 86*a*. The MCU includes a non-volatile memory (such as the memory 52) that is operably coupled to the CPU (such as the CPU 50). The non-volatile memory stores for execution by the CPU a Real Time Operating System and an embedded Artificial Intelligence (AI) code, as indicated at block 86*b*. The MCU includes an I/O port (such as the I/O port 58), as indicated at block 86*c*.

The baseboard includes two or more sensors that are mounted to the baseboard and that are operatively coupled to the I/O port of the MCU. The two or more sensors include two or more of a temperature sensor, a humidity sensor, an ambient light sensor and a microphone, as indicated at block 88. A daughterboard is installed in the selected housing and is operatively coupled to the baseboard, the daughterboard including two or more sensors that are mounted to the daughterboard, as indicated at block 90.

Figure 7:
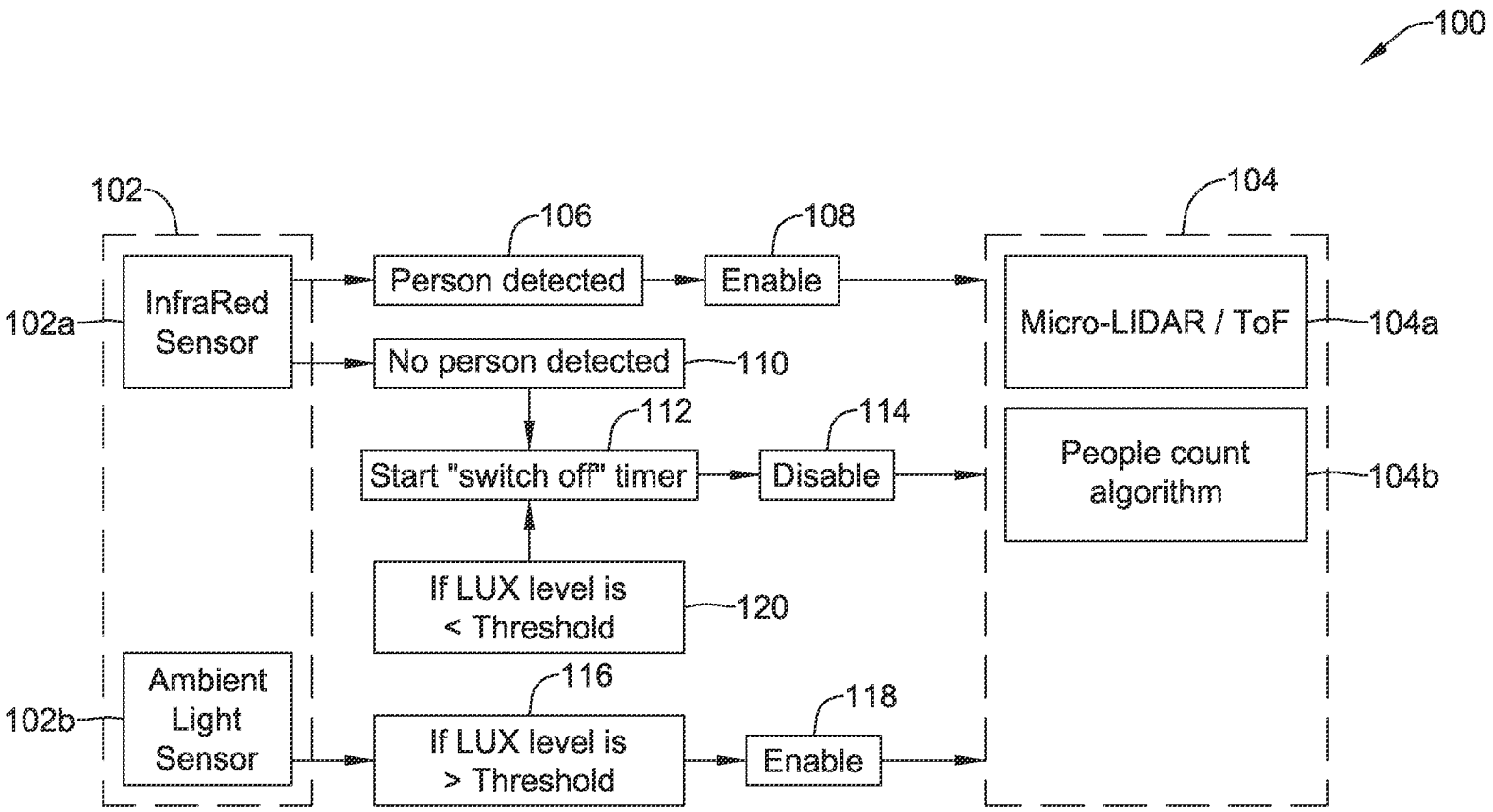
FIG. 7 is a schematic diagram showing an illustrative method of occupancy sensing.

FIG. 7 is a schematic diagram showing an illustrative method 100 of occupancy sensing using both an ultra-low power sensor 102 that is always powered on and a low power sensor 104 that is only active when needed. This may be considered as an example of the sensing assembly 10 or the sensing assembly 30. The ultra-low power sensor 102, which may include an infrared (IR) sensor 102*a* and an ambient light sensor 102*b*. The low-power sensor 104 may include a TOF sensor such as a micro-LIDAR sensor 104*a*. In some cases, the micro-LIDAR sensor 104*a* may include a people counting algorithm 104*b*. If the IR sensor 102*a* detects a person, as indicated at block 106, control passes to block 108 and the low power sensor 104 is turned on. If the IR sensor 102*a* does not detect a person, as indicated at block 110, a switch off timer is started, as indicated at block 112, and then the low power sensor 104 is eventually disabled or otherwise put into a sleep or other low power mode, as indicated at block 114.

If the ambient light sensor 102*b* detects an illumination level that meets or exceeds a threshold, as indicated at block 116, control passes to block 118 and the low power sensor 104 is activated. However, if the illumination level is below the threshold, control passes to block 112 and the switch off timer is started.

Figure 8:
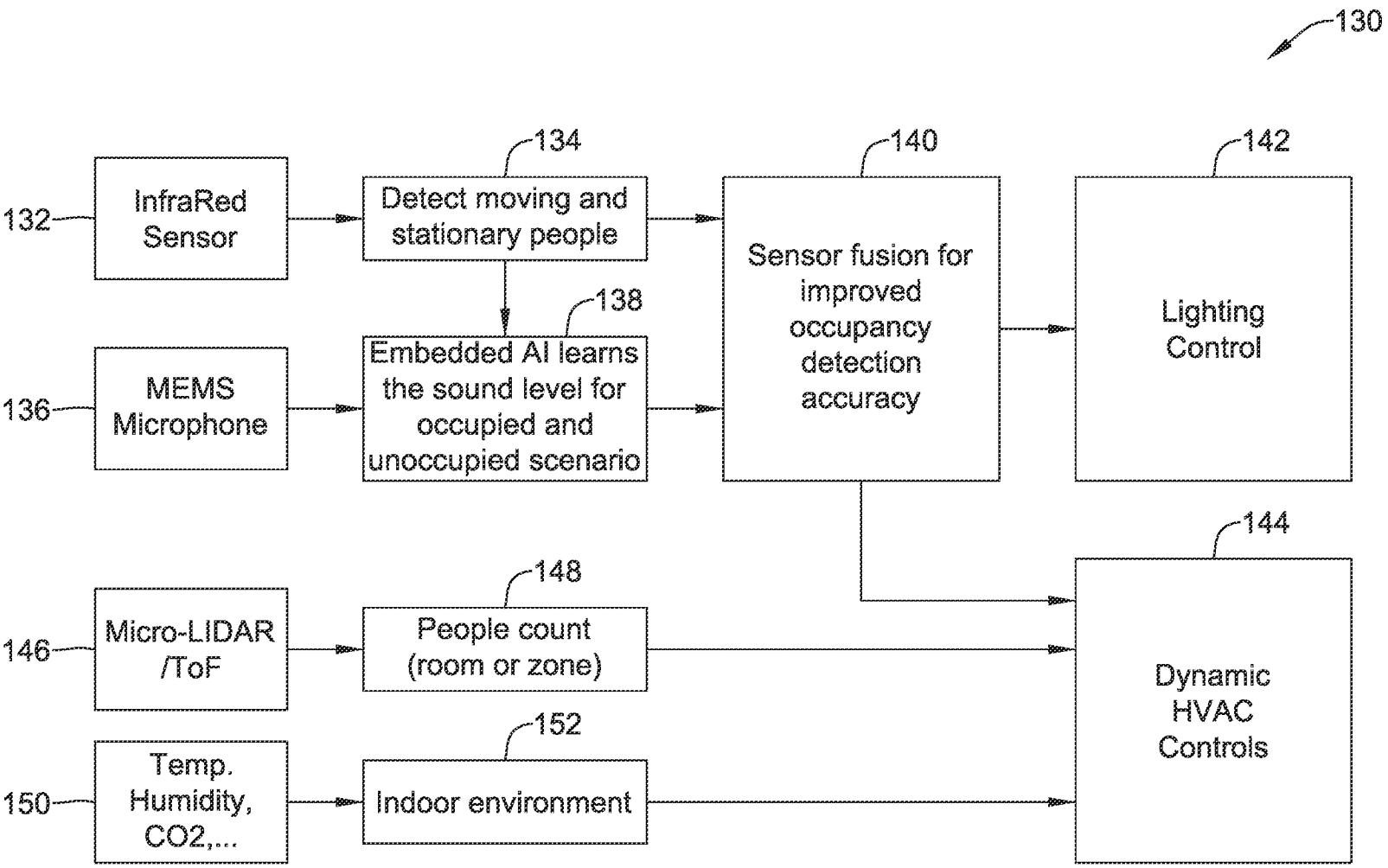
FIG. 8 is a schematic diagram showing an illustrative method of balancing energy efficiency and indoor air quality.

FIG. 8 is a schematic diagram showing an illustrative method 130 of balancing energy efficiency and indoor air quality. This may be considered as an example of the sensing assembly 10 or the sensing assembly 30. An IR sensor 132 detects people, as indicated at block 134. A MEMS microphone 136 detects sounds, and the embedded AI learns what the sound levels should be when a building space is occupied by people and when the building space is not occupied, as indicated at block 138. At block 140, sensor fusion provides for improved occupancy detection accuracy. Control passes both to block 142, which pertains to lighting control, and to block 144, which pertains to dynamic heating, ventilating and air conditioning (HVAC) control. A Micro-LIDAR/TOF sensor 146 counts people within a room or zone, as indicated at block 148. Environmental sensors provide an indication of the indoor environment and perhaps the air quality within the indoor environment, as indicated at block 152. Both block 148 and block 152 pass control to the dynamic HVAC control block 144. Dynamic HVAC control block 144 the controls the HVAC system based on the various inputs.

Figure 9:
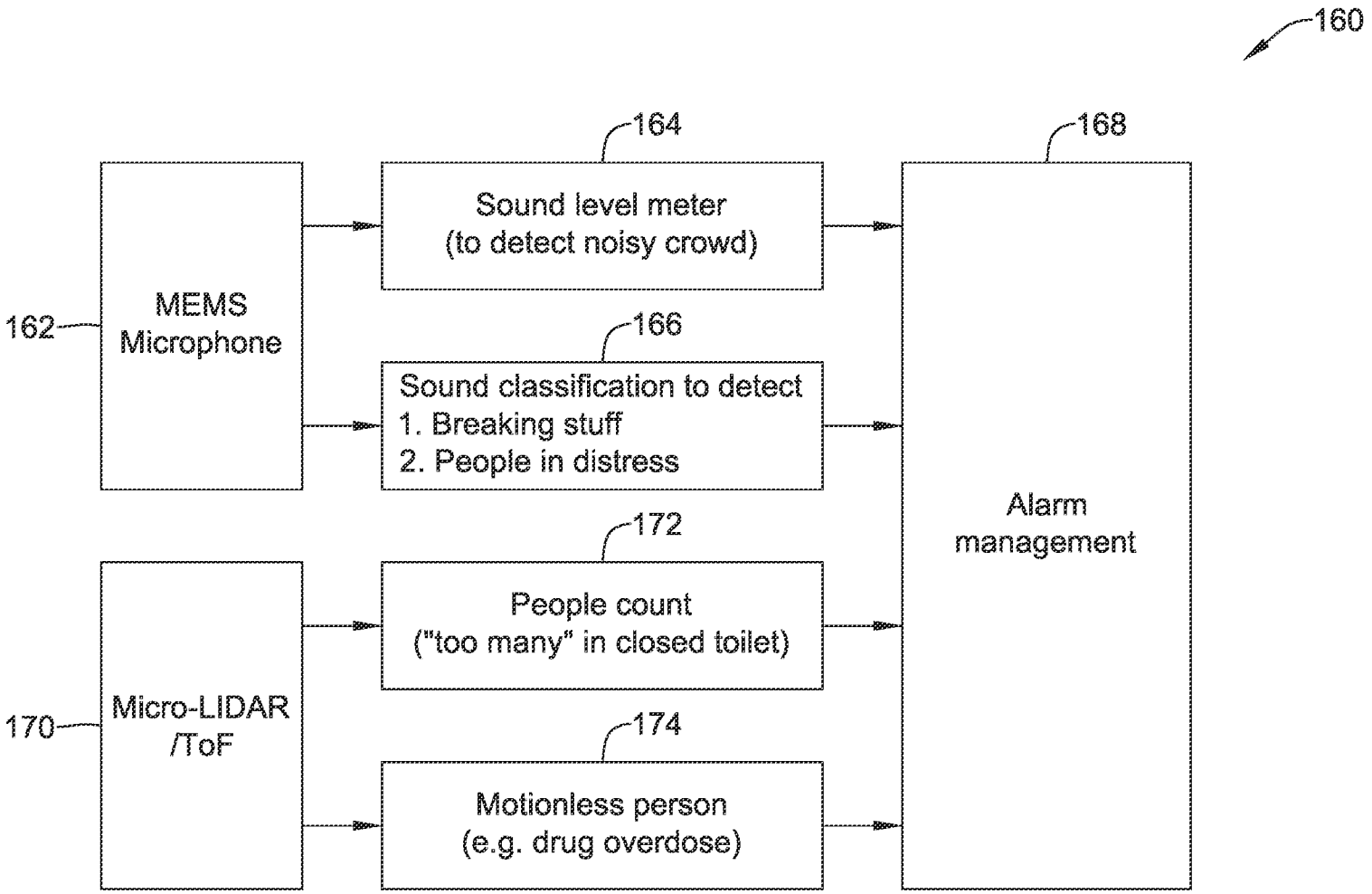
FIG. 9 is a schematic diagram showing an illustrative method of detecting inappropriate behavior.

FIG. 9 is a schematic diagram showing an illustrative method of detecting inappropriate behavior. In this particular example, the inappropriate behavior centers around possible problems within a restroom in a building. A MEMS microphone 162 detects sounds within the space. If the sound exceeds a threshold, a determination may be made that there are more people in the space than are expected, as indicated at block 164. Obviously, the expected crowd within a bathroom is different than that expected in another type of space. The sounds detected by the MEMS microphone 162 are also analyzed for indications of problems, as indicated at block 166. This may include sounds of things being broken, or perhaps sounds of a person in distress (crying, yelling, etc.). At the same time, a Micro-LIDAR/TOF sensor 170 may count how many people are in the space, as indicated at block 172. This can serve as a back-up or confirmation of the crowd estimated using sound processing. The Micro-LIDAR/TOF sensor 170 can also detect a motionless person, which may be an indication of a drug overdose or other health problem. In each case, the information gleaned by processing sound information from the MEMS microphone 162 and the people detection from the Micro-LIDAR/TOF sensor 170 is passed to an alarm management block 168, which issues an alarm when appropriate.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A sensing assembly comprising:

a housing with mounting features for mounting the housing to a mounting surface of a building;

a baseboard housed by the housing, the baseboard including:

a microcontroller unit (MCU) mounted to the baseboard, the MCU including a packaged integrated circuit die, wherein the integrated circuit die includes:

a central processing unit (CPU);

a non-volatile memory operatively coupled to the CPU, wherein the non-volatile memory stores for execution by the CPU:

a Real Time Operating System (RTOS);

an embedded Artificial Intelligence (AI) code;

an I/O port;

two or more sensors mounted to the baseboard and operatively coupled to the I/O port of the MCU, the two or more sensors including two or more of a temperature sensor, a humidity sensor, an ambient light sensor, and a microphone;

a daughterboard housed by the housing and operatively coupled to the baseboard, the daughterboard including two or more sensors mounted to the daughterboard including:

an IR sensor;

a time of flight (TOF) sensor;

the housing defining a window that exposes the IR sensor and the TOF sensor of the daughterboard to a space in the building that is external of the housing;

the MCU of the baseboard is configured to:

receive an output signal from each of the two or more sensors mounted to the daughterboard and the two or more sensors mounted to the baseboard;

process two or more of the output signals using the embedded AI code to produce one or more output parameters; and output the one or more output parameters via the I/O port of the MCU to the baseboard.

2. The sensing assembly of claim 1, wherein the one or more output parameters comprises one or more occupancy parameters.

3. The sensing assembly of claim 2, wherein the one or more occupancy parameters comprises one or more of human presence, people count, people flow and people tracking.

4. The sensing assembly of claim 1, wherein the one or more output parameters comprises one or more environmental parameters.

5. The sensing assembly of claim 4, wherein the one or more environmental parameters comprises one or more of noise, illuminance and Indoor Air Quality (IAQ).

6. The sensing assembly of claim 1, wherein the one or more output parameters comprises one or more anomaly detection parameters.

7. The sensing assembly of claim 6, wherein the one or more the one or more anomaly detection parameters comprise one or more of an anomalous audio, an anomalous pressure, an anomalous temperature, an anomalous humidity, an anomalous ambient light, an anomalous vibration, an anomalous people presence, an anomalous people count, and an anomalous people flow.

8. The sensing assembly of claim 7, wherein the MCU is configured to identify one or more events and/or faults based at least in part on the one or more anomaly detection parameters.

9. The sensing assembly of claim 1, wherein the field of view (FOV) of the IR sensor overlaps the FOV of the TOF sensor and the FOV of the TOF sensor is smaller than the FOV of the IR sensor, and wherein the TOF sensor has a power savings mode and a sensing mode, wherein after a period of no activity the MCU sets the TOF sensor to the power savings mode, and in response to the IR sensor detecting activity, the MCU sets the TOF sensor to the sensing mode.

10. The sensing assembly of claim 1, wherein the baseboard comprises communication circuitry for communicating one or more of the output parameters to a remote device.

11. The sensing assembly of claim 10, wherein the communication circuitry supports wireless communication.

12. The sensing assembly of claim 10, wherein the baseboard is configured to receive an update or replacement to the embedded Artificial Intelligence (AI) code via the communication circuitry and to update or replace the embedded Artificial Intelligence (AI) code stored in the non-volatile memory of the integrated circuit die of the MCU with the updated or replacement embedded Artificial Intelligence (AI) code.

13. The sensing assembly of claim 10, wherein the non-volatile memory of the integrated circuit die of the MCU further stores one or more drivers for communicating with one or more of the sensors mounted to the daughterboard, and wherein the baseboard is configured to receive an update or replacement of one or more of the drivers via the communication circuitry and update or replace one or more of the drivers stored in the non-volatile memory of the integrated circuit die of the MCU with one or more of the updated or replacement drivers.

14. A sensing assembly comprising:

a baseboard including:

a microcontroller unit (MCU) mounted to the baseboard, the MCU executing a Real Time Operating System (RTOS) and embedded Artificial Intelligence (AI) code;

two or more sensors mounted to the baseboard and operatively coupled to the MCU, the two or more sensors including two or more of a temperature sensor, a humidity sensor, an ambient light sensor, and a microphone;

a daughterboard operatively coupled to the baseboard, the daughterboard including two or more sensors mounted to the daughterboard;

the MCU of the baseboard is configured to:

receive an output signal from each of the two or more sensors mounted to the daughterboard and the two or more sensors mounted to the baseboard;

process two or more of the output signals using the embedded AI to produce one or more output parameters; and the baseboard includes communication circuitry for communicating one or more of the output parameters to a remote device.

15. The sensing assembly of claim 14, wherein the daughterboard includes one or more of an IR sensor, a time of flight (TOF) sensor, a temperature sensor, a humidity sensor, a carbon dioxide ($CO_2$) sensor, a carbon monoxide (CO) sensor, a total VOC sensor and a particulate matter (PM) sensor.

16. The sensing assembly of claim 14, wherein the embedded AI is configured to learn to detect anomalies based at least in part on one or more of the processed output signals.

17. The sensing assembly of claim 14, wherein the sensing assembly further comprises:

a power storage device for powering the sensing assembly; and a power harvesting device for harvesting power from the ambient environment to recharge the power storage device.

18. A method of assembling a sensing assembly comprising:

selecting a housing from a first housing and a second housing, wherein the first housing includes a sensor window that is orientated in a first orientation relative to a mounting surface, and the second housing includes a sensor window that is orientated in a second orientation relative to the mounting surface;

installing a baseboard in the selected housing, wherein the baseboard includes:

a microcontroller unit (MCU) mounted to the baseboard, the MCU including a packaged integrated circuit die, wherein the integrated circuit die includes:

a central processing unit (CPU);

a non-volatile memory operatively coupled to the CPU, wherein the non-volatile memory stores for execution by the CPU:

a Real Time Operating System (RTOS);

an embedded Artificial Intelligence (AI) code;

an I/O port;

two or more sensors mounted to the baseboard and operatively coupled to the I/O port of the MCU, the two or more sensors including two or more of a temperature sensor, a humidity sensor, an ambient light sensor, and a microphone;

installing a daughterboard in the selected housing and operatively coupling the daughterboard to the baseboard, wherein the daughterboard includes two or more sensors mounted to the daughterboard;

the first housing, when selected, supporting the daughterboard in an orientation where at least one of the two or more sensors mounted to the daughterboard are orientated toward and aligned with the sensor window of the first housing; and the second housing, when selected, supporting the daughterboard in an orientation where at least one of the two or more sensors mounted to the daughterboard are orientated toward and aligned with the sensor window of the second housing.

19. The method of claim 18, wherein the first housing includes two opposing major surfaces with sidewalls extending between the two opposing major surfaces, and wherein the sensor window of the first housing extends along one of the two opposing major surfaces.

20. The method of claim 19, wherein the second housing includes two opposing major surfaces with sidewalls extending between the two opposing major surfaces, and wherein the sensor window of the second housing extends along one of the sidewalls.

* * * * *